US007194228B2

(12) United States Patent
Arimitsu et al.

(10) Patent No.: US 7,194,228 B2
(45) Date of Patent: Mar. 20, 2007

(54) CHARGING APPARATUS, PROCESS CARTRIDGE, AND IMAGE FORMING APPARATUS

(75) Inventors: Takeshi Arimitsu, Kanagawa (JP); Masanari Morita, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 235 days.

(21) Appl. No.: 10/993,471

(22) Filed: Nov. 19, 2004

(65) Prior Publication Data

US 2005/0111881 A1 May 26, 2005

(30) Foreign Application Priority Data

Nov. 21, 2003 (JP) ..... 2003-391699

(51) Int. Cl.
*G03G 15/00* (2006.01)
*G03G 15/02* (2006.01)

(52) U.S. Cl. ..... 399/167; 399/111; 399/174

(58) Field of Classification Search ..... 399/75, 399/167, 168, 115, 111, 174, 176
See application file for complete search history.

(56) References Cited

U.S. PATENT DOCUMENTS 6,038,420 A 3/2000 Hirabayashi
6,118,957 A 9/2000 Fujiwara
6,385,420 B1 * 5/2002 Morioka ..... 399/174
6,600,886 B2 7/2003 Tsukida
6,882,813 B2 * 4/2005 Lee ..... 399/176 X
2003/0235429 A1 * 12/2003 Sato et al. ..... 399/111
2004/0013446 A1 * 1/2004 Morioka et al. ..... 399/111
2004/0037590 A1 * 2/2004 Morioka et al. ..... 399/167

FOREIGN PATENT DOCUMENTS

JP 2000-181327 A * 6/2000
JP 2001-166562 A 6/2001
JP 2002-123062 A 4/2002
JP 2003-316117 A * 11/2003

* cited by examiner

*Primary Examiner*—Sophia S. Chen
(74) *Attorney, Agent, or Firm*—Canon U.S.A. Inc I.P. Div

(57) ABSTRACT

A charging apparatus having a charging device for contact charging a rotatable member. The charging device rotates upon reception of a drive force from a drive force transmitting device. The axis of rotation of the charging roller and the axis of rotation of the photoreceptor drum intersect each other. It is a characteristic of the invention that a force received by the charging device from the drive force transmitting device and a force generated between charging device and the rotatable member are oriented in the same direction. With this arrangement, the thrust position of the charging device when the charging device is driven is stabilized.

11 Claims, 36 Drawing Sheets

CHARGING APPARATUS, PROCESS CARTRIDGE, AND IMAGE FORMING APPARATUS

This application claims priority from Japanese Patent Application No. 2003-391699 filed Nov. 21, 2003, which is hereby incorporated by reference herein.

BACKGROUND OF THE INVENTION

1. Field of the Invention

The present invention relates to a charging apparatus, a process cartridge, and an image forming apparatus.

2. Description of the Related Art

In this specification, an image forming apparatus represents an apparatus which forms an image on a recording medium using an electrophotographic image forming method. The electrophotographic image forming apparatus can be, for example, an electrophotographic copying machine, an electrophotographic printer (for example, a laser printer and LED printer), a facsimile machine, a word processor, and a complex machine thereof (a multi-function printer, for example).

The process cartridge represents a member, which includes a charging device, a developing device, and a cleaning device integrally combined with an electrophotographic photoreceptor into a cartridge body. The process cartridge is capable of being attached to and detached from a main body of the image forming apparatus. It is also capable of attaching to and detaching from the main body of the image forming apparatus by integrating at least one of the charging device, the developing device, and the cleaning device with the electrophotographic photoreceptor into a cartridge body.

In the electrophotographic image forming apparatus in the related art, a corona charger (corona discharger) has been used as a charging apparatus for uniformly charging (or for diselectrifying) an image carrying member, such as the electrophotographic photoreceptor or an electrostatic recording dielectric material, so as to provide the image carrying member with the required polarity and potential.

The corona charger has a discharging electrode, such as a wire electrode, and a shield electrode surrounding the discharging polarity. The charger is disposed with a discharging opening opposed to the image carrying member in a non-contact manner. The surface of the image carrying member is charged at a predetermined potential by exposing the surface of the image carrying member to a discharging current generated by applying a high voltage to the discharging electrode and the shield electrode.

In recent years, a contact charging apparatus having lower ozone and lower electric power in comparison with corona charging have been used.

The contact charging apparatus brings a charging member to the image carrying member to charge the surface of the image carrying member to the predetermined potential and polarity by applying a bias voltage to the charging member. The charging member can be a roller type, a fur-brush type, a magnetic brush type, and a blade type.

The contact charging apparatus can include a discharging mechanism, for charging the vicinity of a contact portion between the charging member and the image carrying member, and a direct injection charging mechanism. With the direct injection charging mechanism (also referred to as direct charging, injection charging, or electric charge injection charging), an electric charge is directly injected from the contact portion between the contact charging member and the image carrying member to charge the surface of the image carrying member. In this case, since the process does not include discharging, even when a voltage applied to the contact charging member is lower than a discharging threshold, the surface of the image carrying member can be charged to a potential corresponding to the applied voltage, and no harmful effect due to resultant products of the discharging process is generated.

As a contact charging apparatus using the direct injection charging mechanism, a structure in which a conductive resilient charging roller is used as the contact charging member and conductive fine powder (charging promoting particles) for promoting charging is interposed on a contact surface between the image carrying member and the charging roller (For example, as disclosed in U.S. Pat. No. 6,038,420), and an apparatus and structure in which a charging roller and the image carrying member rotate while maintaining a relative speed difference (for example, Japanese Patent Laid-Open No. 2001-166562, Japanese Patent Laid-Open No. 2002-123062) are known. In the charging apparatus using a charging roller which is driven in contact with the photoreceptor drum, a structure in which an axis of rotation of the charging roller and an axis of rotation of the photoreceptor drum are disposed at a predetermined crossing angle for determining the longitudinally positioning of the charging roller is known (Japanese Patent Laid-Open No. 2002-072625, corresponding U.S. Pat. No. 6,600,886 B2).

SUMMARY OF THE INVENTION

The present invention is directed to a charging apparatus, a process cartridge incorporating the charging apparatus, and an image forming apparatus incorporating the process cartridge.

In one aspect, a charging apparatus for charging a rotatable member includes a charging device contacting the member at a contact point and operable to charge the rotatable member; and a drive force transmitting device transmitting a drive force to the charging device so as to rotate the charging device along an axis of rotation. The rotatable member applies a first force to the charging device along the axis of rotation at the contact point, and the drive force transmitting device applies a second force to the charging device along the axis of rotation. The directions of the first and second forces are substantially the same.

Further features and advantages of the present invention will become apparent from the following description of the embodiments with reference to the attached drawings.

DESCRIPTION OF THE EMBODIMENTS

Figure 1:
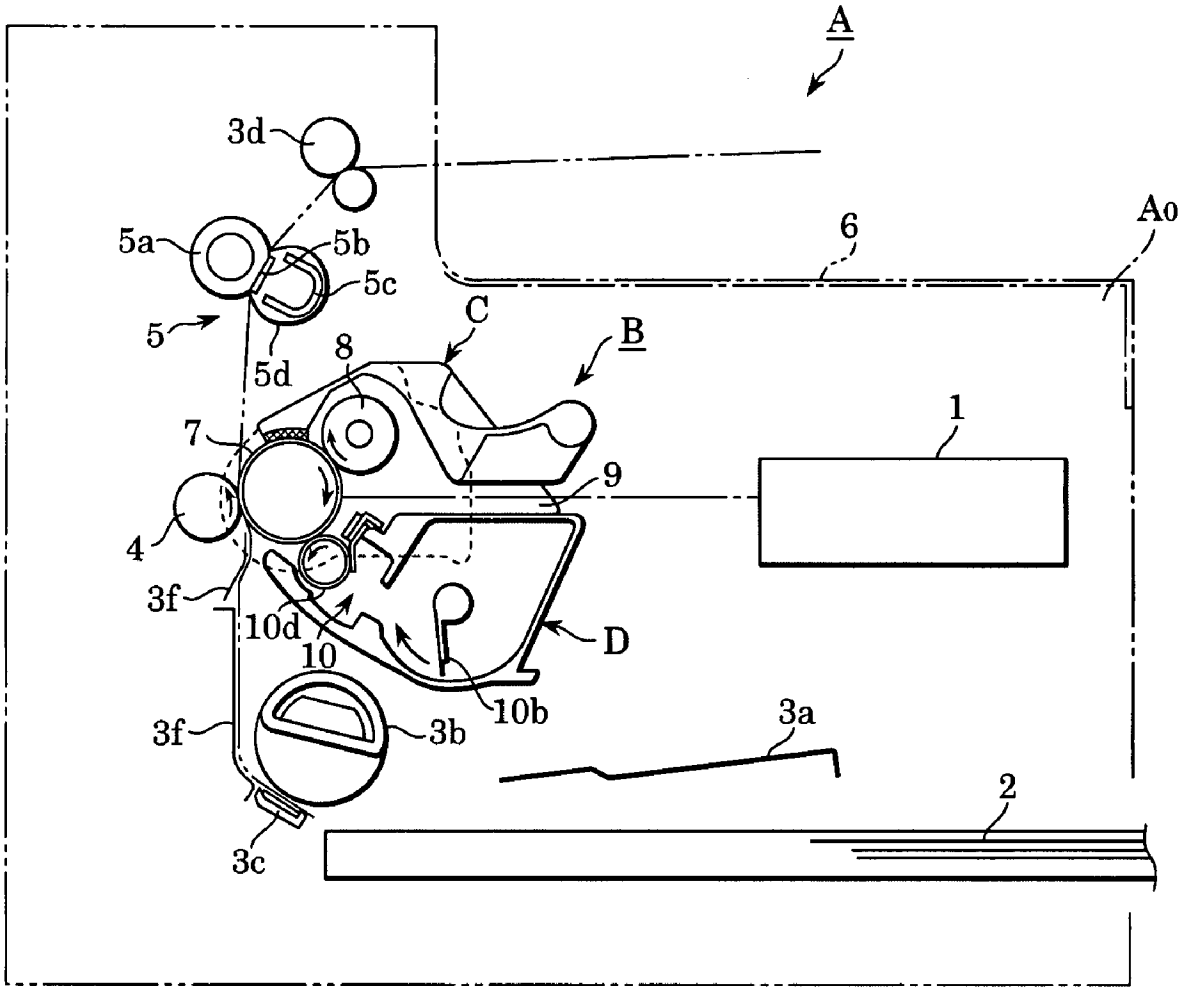
FIG. 1 is a schematic drawing of an electrophotographic image forming apparatus according to one embodiment of the present invention.

Hereinafter, referring to the drawings, a process cartridge and an electrophotographic image forming apparatus according to the invention will be described.

In the description below, the longitudinal direction of a process cartridge represents a direction intersecting (substantially orthogonal to) the attaching and detaching direction of the process cartridge with respect to the main body of an apparatus, as well as a direction parallel to the surface of a recording medium and intersecting (substantially orthogonal to) the direction to transfer the recording medium. The upper surface of the process cartridge is a surface positioned on the upper side in a state in which the process cartridge is attached to the main body of the apparatus, and the lower surface (bottom surface) is a surface positioned on the lower side. The left and right sides of the process cartridge correspond to the left and right sides when viewing the recording medium from the printing surface.

Figure 2:
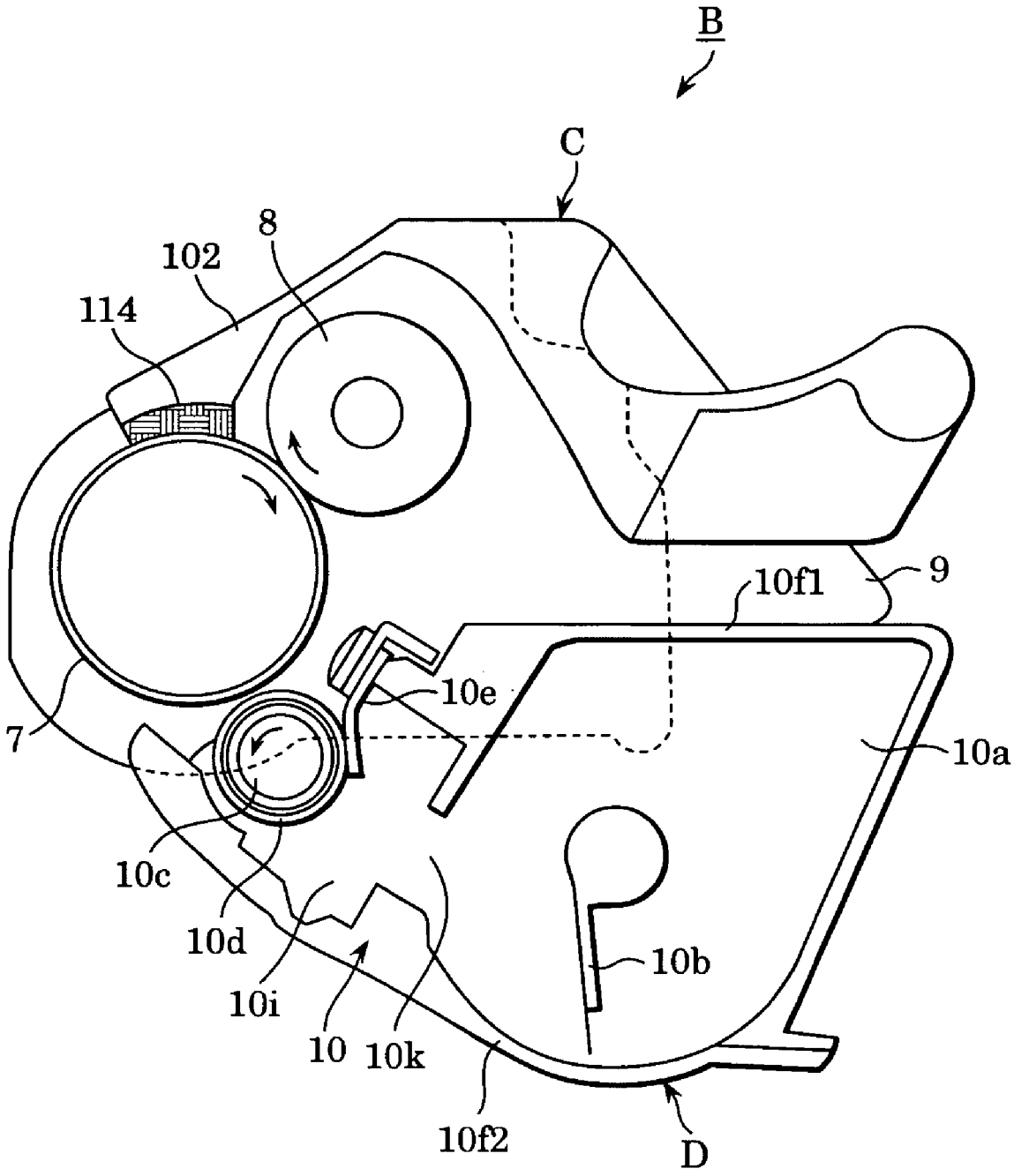
FIG. 2 is a schematic drawing of the process cartridge shown in FIG. 1.

FIG. 1 is a schematic drawing of an electrophotographic image forming apparatus A in accordance with one embodiment of the present invention. In this embodiment, a process cartridge B shown in FIG. 2 is detachably attached. FIG. 1 is a pattern illustration showing a structure of the electrophotographic image forming apparatus on which the process cartridge B is mounted, and FIG. 2 is a pattern illustration showing a structure of the process cartridge B.

As the order of explanation, an entire structure of the process cartridge B and the electrophotographic image forming apparatus A incorporating the same will be described first, and then the structure of the process cartridge B and of a process cartridge mounting guide mechanism for attaching and detaching the process cartridge B to the main body of the electrophotographic image forming apparatus will be described.

(Entire Structure)

In the present embodiment, the electrophotographic image forming apparatus A (hereinafter, referred to as an "image forming apparatus"), such as a laser beam printer, includes a drum-shaped electrophotographic photoreceptor (hereinafter, referred to as a "photoreceptor drum") 7. The photoreceptor drum 7 corresponds to an image carrying member having a photosensitive layer such as an organic photoconductor layer on the outer periphery of an aluminum cylinder as shown in FIG. 1.

Information light based on image information is irradiated from an optical system 1 to the photoreceptor drum 7 to form a latent image on the photoreceptor drum 7. The latent image is developed with developer (hereinafter, referred to as "toner") to form a toner image.

Synchronous with formation of the toner image, recording media 2 is separately distributed from a sheet-feeding cassette 3*a* one by one via a pickup roller 3*b*, a press-contact member 3*c* which comes into press contact thereto, and a transfer device 3*f*.

The toner image formed on the photoreceptor drum 7 is transferred to the recording medium 2 by applying a voltage to a transfer roller 4, serving as a transfer device. The recording medium 2 is thereafter transferred to a fixing device 5 by the transfer device 3*f*.

The fixing device 5 includes a drive roller 5*a* and a fixing revolving member 5*d*. The fixing revolving member 5*d* includes a cylindrical sheet and a heater 5*b* built therein. The member 5*d* is rotatably supported by a supporting member 5*c*. The fixing device 5 fixes the transferred toner image by applying heat and pressure on the recording medium 2 passing therethrough. Then, the recording medium 2 is transferred by a discharging roller pair 3*d* and discharged to a discharging section 6.

(Process Cartridge)

The process cartridge B includes at least one processing device. The processing device includes, for example, a charging device for charging the electrophotographic photoreceptor and a developing device for developing a latent image formed on the electrophotographic photoreceptor.

As shown in FIG. 1 and FIG. 2, the process cartridge B of the present embodiment rotates the photoreceptor drum 7 and uniformly charges the surface of the photoreceptor drum 7 by applying a voltage to a charging roller 8, which serves as the charging device. A latent image is formed by exposing a light image from the optical system 1 to the charged photoreceptor drum 7 via an exposing opening 9, so that the latent image is developed by a developing device 10.

In this embodiment, the developing device 10 feeds a toner (one component magnetic developer) in a toner chamber (toner storage) 10*a* defined by a toner developing frame 10*f*1 and a lid member 10*f*2 by a rotatable toner transfer device (toner transferring member) 10*b* through an opening 10*k* of the toner developing frame 10*f*1 to a developing chamber 10*i*. Then, a developing roller 10*d*, which corresponds to the developing revolving member including a fixed magnet 10*c* built therein, is rotated. Simultaneously, a toner layer having a charge provided by a developing blade 10*e* is formed on the surface of the developing roller 10*d*. Then, the toner is transferred to the photoreceptor drum 7 according to the latent image, so that a toner image is formed and visualized.

Subsequently, a voltage having an opposite polarity from the toner image is applied to the transfer roller 4 to transfer the toner image to the recording medium 2. It is adapted such that residual toner remaining on the photoreceptor drum 7 is collected by a fogging-removal bias (a direct voltage applied to the developing apparatus and a fogging-removal potential difference Vback, which is a potential difference between the potentials on the surface of the photoreceptor) at the time of development from the next process on. In the present embodiment, a cleaning device for removing residual toner on the photoreceptor drum 7, such as a cleaning blade, is not provided.

The process cartridge B, described in detail later, is detachably attached to the main body of the image forming apparatus A (that is, to the cartridge mounting device provided on an apparatus body A0) via guiding portions provided at both ends of the cartridge.

The process cartridge B is formed by integrally assembling a drum frame unit C and a developing unit D by connecting a drum frame 102 constituting the cartridge frame and the toner developing frame 10*f*1.

(Drum Frame Unit C)

Referring now to FIG. 3 to FIG. 7, components of the drum frame unit C, such as the photoreceptor drum 7 and the charging roller 8, will be described.

Photoreceptor Drum 7

Figure 5:
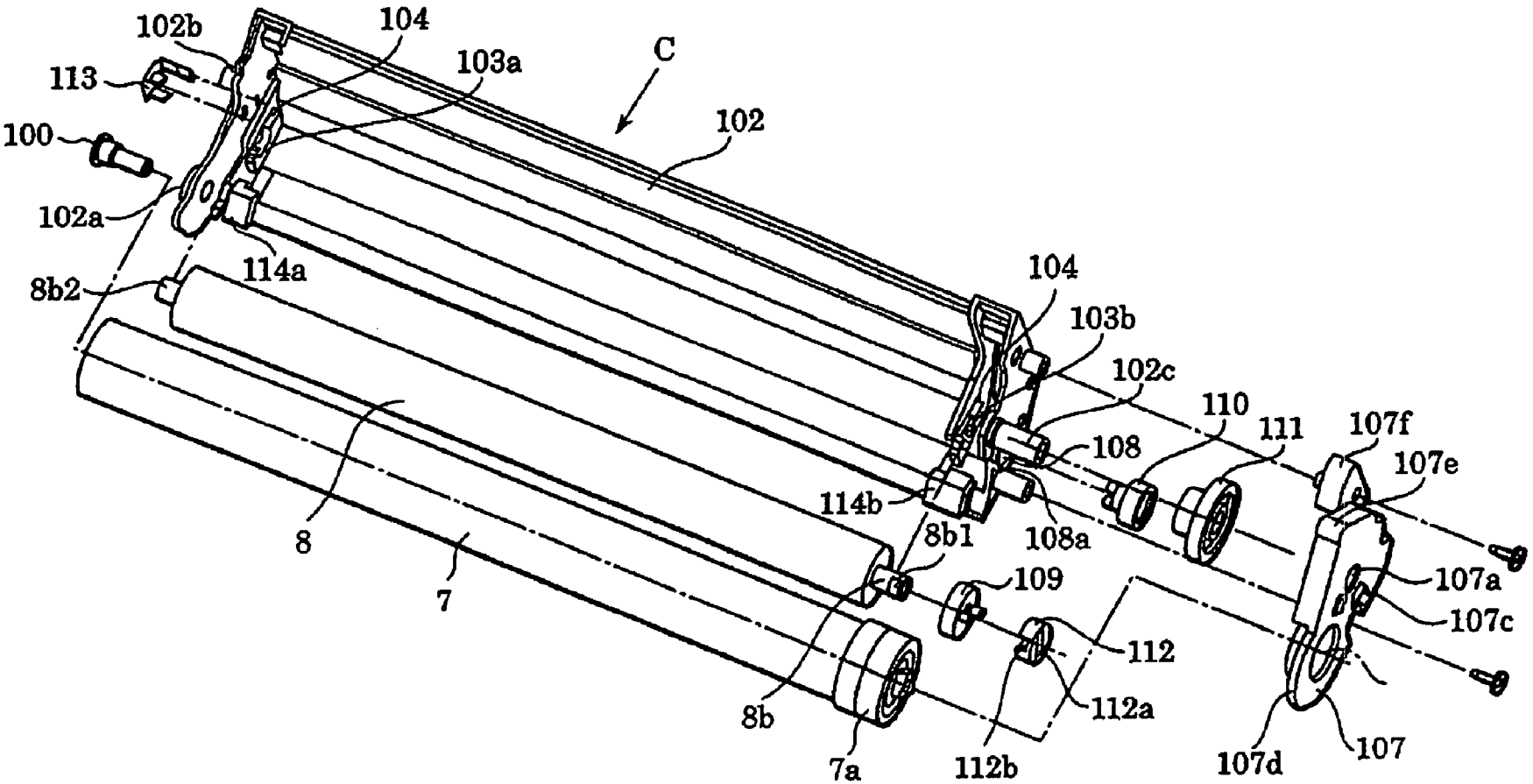
FIG. 5 is an exploded perspective view of the drum frame unit of the process cartridge shown in FIG. 2.
Figure 6:
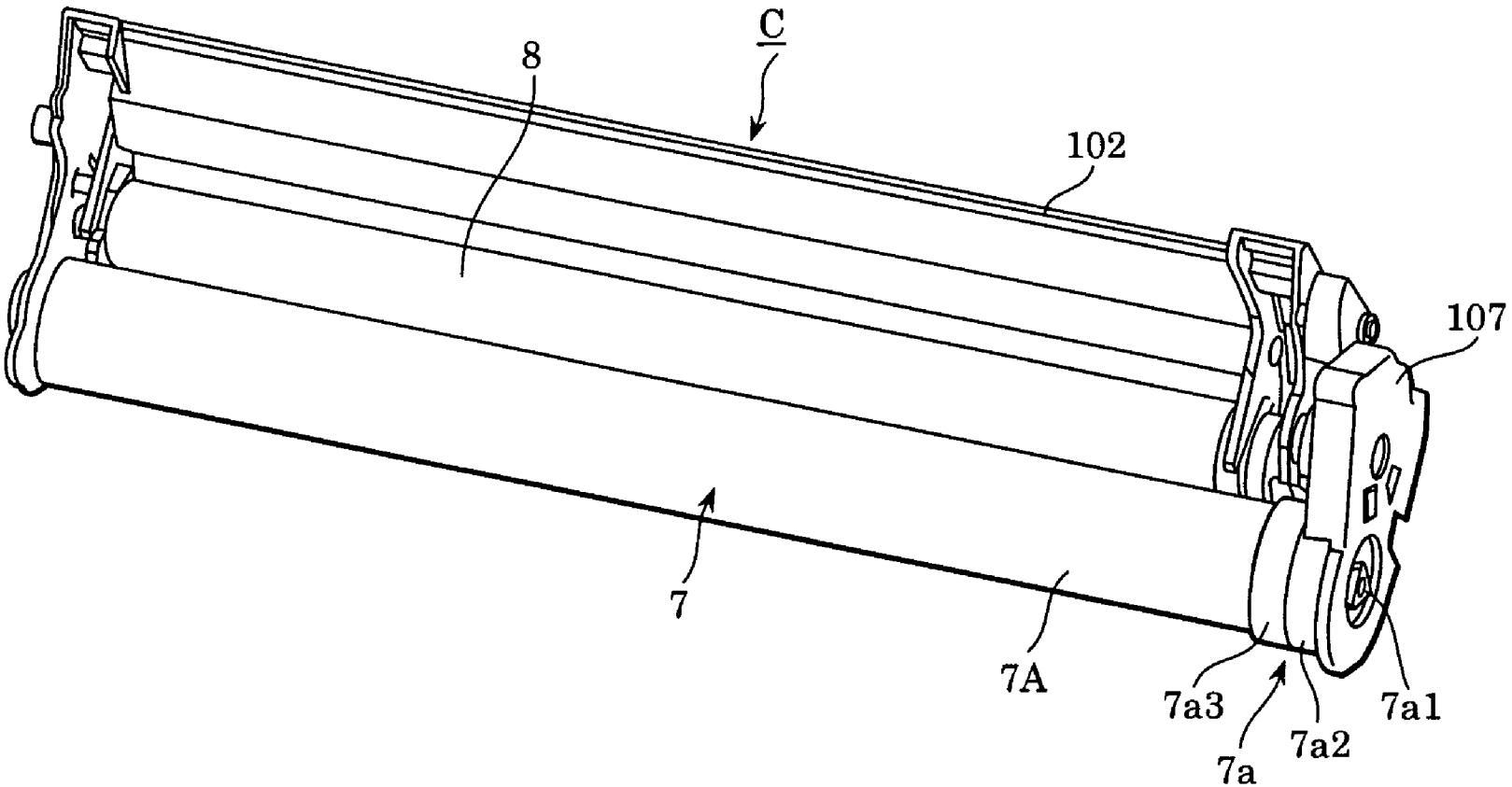
FIG. 6 is a perspective view of the drum frame unit of the process cartridge shown in FIG. 2.

FIG. 5 is an exploded perspective view of the drum frame unit C of the process cartridge shown in FIG. 2. FIG. 6 is a perspective view of the drum frame unit C of the process cartridge shown in FIG. 2. In FIG. 5 and FIG. 6, a drum gear 7*a* is fixed at the end of the photoreceptor drum 7. The drum gear 7*a* is provided with a triangular coupling member 7*a*1 having a shape of a twisted triangular pole, which serves as a drive force receiving portion for receiving a drive force from the image forming apparatus body A0, a first helical gear portion 7*a*2 for transmitting a drive force to the charging roller 8, and a second helical gear portion 7*a*3 for transmitting a drive force to the developing unit D. At the other end, although not shown, a flange on which an electrode for grounding the photoreceptor drum 7 is integrally fixed, is connected.

Figure 7:
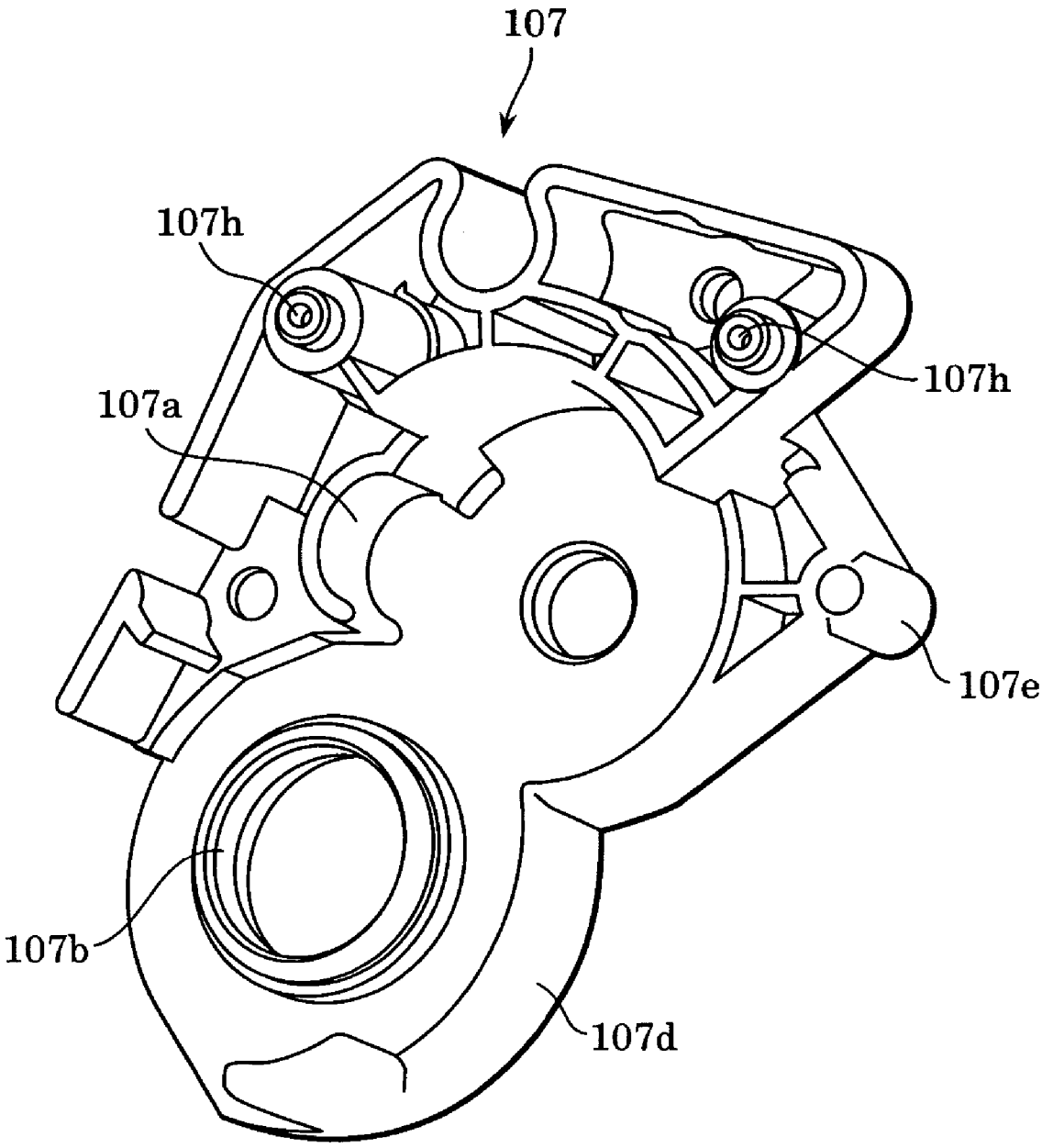
FIG. 7 is a perspective view of a side holder of the drum frame unit.

FIG. 7 is a perspective view of a side holder of the drum frame unit C. The drive force transmitting side of the photoreceptor drum 7 is rotatably attached to the drum frame 102 via a side holder 107 having a drum bearing 107*b* (FIG. 7) integrally formed therewith. The other end is rotatably mounted to a drum frame 102 containing the photoreceptor drum 7 and the charging roller 8 via a drum supporting shaft. The diameter of the photoreceptor drum can be ϕ20–40.

The second helical gear portion 7*a*3 of the drum gear 7*a* is located at the position near a cap roller 10*m* (also referred and shown as 10*m*1 and 10*m*2) (see FIG. 19) which defines the interaxial distance between the developing roller 10*d* and the photoreceptor drum 7. In this case, the distance of pitches of the second helical gear portion 7*a*3 and a developing roller gear 10*n* (see FIG. 10) can be maintained with high degree of accuracy.

Charging Roller 8

The charging roller 8 includes a conductive shaft member 8*b* and a resilient abutting portion 8*a* formed integrally around thereof. The axial length of the shaft member 8*b* is longer than the axial length of the abutting portion 8*a*, and includes shaft portions 8*b*1, 8*b*2 exposing from both ends of the abutting portion 8*a*. The diameter of the charging roller 8 can be ϕ8–20.

Conductive fine powder is interposed between the outer peripheral surface of the photoreceptor drum 7 and the abutting portion 8*a* of the charging roller 8. The conductive fine powder can be fine particles of zinc oxide (1500 Ω·cm in resistance, 35% in coefficient of transmittance) of 1.5 μm in volume average diameter including 35 volume percent of particles having diameters of 0.5 μm or smaller, and 0 to several volume percent of particles having diameters of 5 μm or larger in distribution, prepared by means of air classification of particles obtained by palletizing zinc oxide initial particles of 0.1–0.3 μm in diameter by applying a pressure.

Charging Roller Bearing Member 103 (103*a* and 103*b*)

Figure 33:
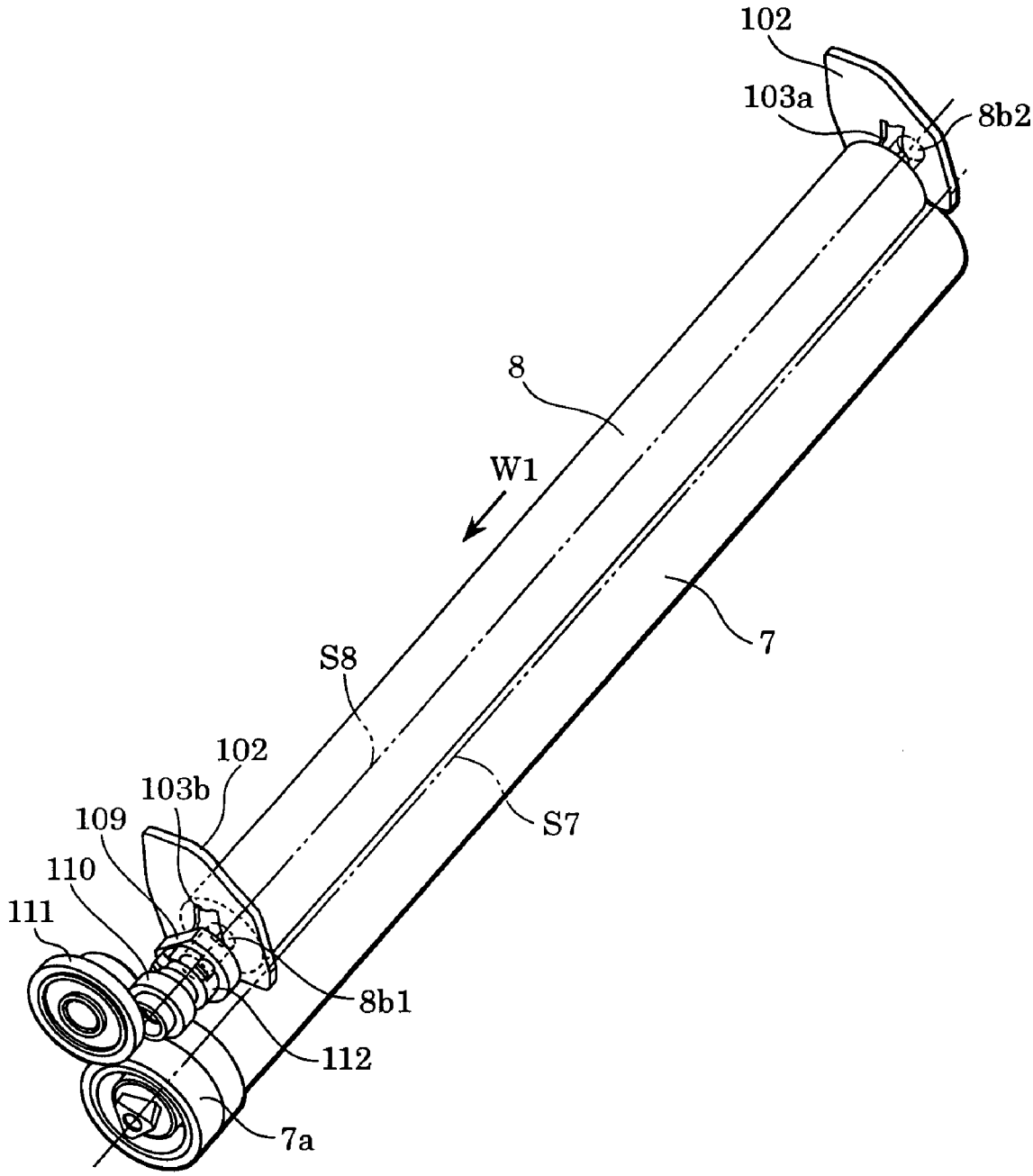
FIG. 33 is a schematic perspective view showing a charging roller supporting structure.

Referring also to FIG. 33, a charging roller bearing member will be described. Charging roller bearing members 103*a*, 103*b* corresponding to the shaft portions 8*b*1, 8*b*2 of the charging roller 8 are attached thereto. The charging roller bearing members 103*a*, 103*b* are substantially C-shaped in cross section, and are in contact with the shaft portions 8*b*1, 8*b*2 with the inner peripheral surface of the C-shape.

Furthermore, the charging roller bearing members 103*a*, 103*b* include engaging portions (not shown) which engage a part of the drum frame 102, so that an assembly of the charging roller 8 and the charging roller bearing member 103 is movable with respect to the photoreceptor drum 7. The direction of movement of the assembly constrained by the engaging portion is a linear direction connecting the centers of the photoreceptor drum 7 and the charging roller 8. The straight line connecting between the centers of the photoreceptor drum 7 and the charging roller 8 has a relative angle on the side of the shaft portion 8*b*1 and on the side of the shaft portion 8*b*2, that is, at both ends of the charging roller 8. Accordingly, an axis of rotation S8 of the charging roller 8 and an axis of rotation S7 of the photoreceptor drum 7 intersect with respect to each other. Consequently, a frictional force as a first force which the charging roller 8 receives from the photoreceptor drum 7 is generated at the abutting portion between the charging roller 8 and the photoreceptor drum 7 when driving the charging roller 8 and the photoreceptor drum 7, and the charging roller 8 is constantly urged in a predetermine thrust direction by an axial component force W1 of the frictional force. In the present embodiment, the direction of the straight line connecting the centers of the photoreceptor drum 7 and the charging roller 8 on the side of the driven force input side, that is, on the side of the shaft portion 8*b*1 is located on the downstream side of the direction of the straight line connecting between the centers of the photoreceptor drum 7 and the charging roller 8 on the side of the driven force input side, that is, on the side of the shaft portion 8*b*2 with respect to the direction of rotation of the photoreceptor drum 7. Therefore, the charging roller 8 is urged toward the drive force input side. The relative angle between the directions of the straight lines connecting between the centers of the photoreceptor drum 7 and the charging roller 8 on the side of the shaft portion 8*b*1 and the side of the shaft portion 8*b*2 can be about 2 degrees.

Compression Coil Spring 104

Figure 32:
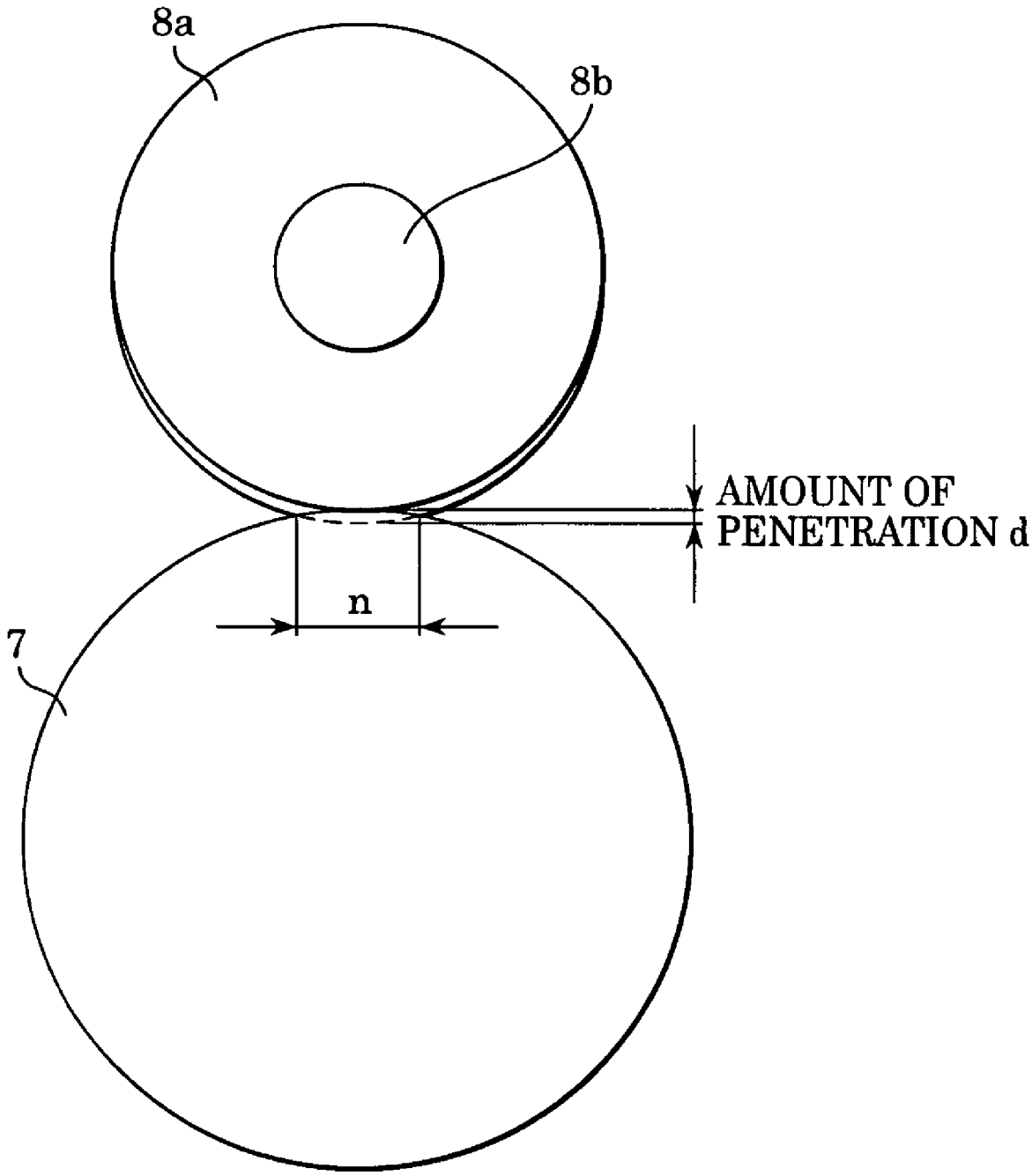
FIG. 32 is a schematic illustration showing the amount of penetration of the charging roller and the nip portion of the charging roller.

A compression coil spring 104, which is a resilient member, is attached between the drum frame 102 and the charging roller bearing members 103*a*, 103*b*. Both ends of the compression coil spring 104 are fitted on mounting portions between the charging roller bearings 103*a*, 103*b* and the drum frame 102. The charging roller 8 is pressed and brought into contact with the photoreceptor drum 7 by the compression coil spring 104. At this time, since the abutting portion 8*a* of the charging roller 8 is a resilient member as described above, it receives a load from the compression coil spring 104 and is compressed by a predetermined amount. The compressed amount of the abutting portion 8*a* shown in FIG. 32 is assumed to be the amount of penetration d, and the contact area between the compressed abutting portion 8*a* and the photoreceptor drum 7 is assumed to be a contact nip portion (charged nip portion) n.

More specifically, two compression coil springs 104 of 340*gf* in operating load are used for left and right for maintaining the amount of penetration of the charging roller 8 to 0.2 mm. The compression coil spring 104 has a spring constant of about 3 mm in the amount of compression.

In the invention, a method of controlling the amount of penetration of the charging roller 8 employed here is a method of control only by the pressing force of the compression coil spring 104.

The driving structure of the charging roller will be described later.

(Driving Structure of Developing Roller 10*d*, Transfer Roller 4, and Toner Transferring Member 10*b*)

Figure 10:
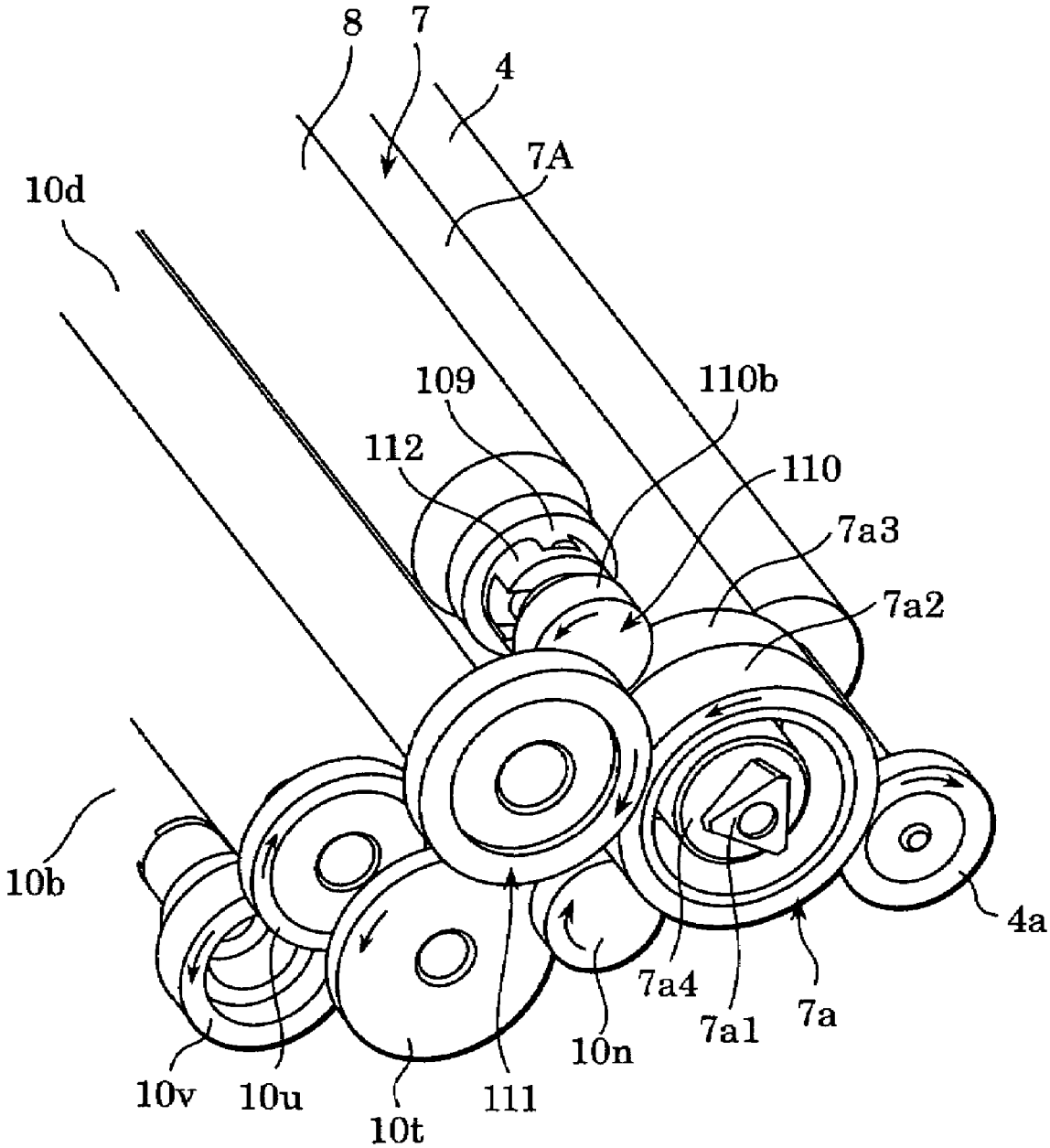
FIG. 10 is a perspective view illustrating an embodiment of a process cartridge driving structure.

As will be described later, the drum gear 7*a* drives the charging roller 8 via an idler gear 111, and a joint gear 110. Further, as shown in FIG. 10, the drum gear 7*a* also drives the toner transferring member 10*b*, the developing roller 10*d*, and the transfer roller 4 via the gears 10*n*, 10*t*, 10*u* and 10*v*.

The first helical gear portion 7*a*2 transfers a rotational drive force to the charging roller 8 via the idler gear 111, the joint gear 110 and the joint 109. Simultaneously, the first helical gear portion 7*a*2 engages a gear 4*a* disposed at the shaft end of the transfer roller 4, and transfers the rotational drive force to the transfer roller 4.

A second helical gear portion 7*a*3 of the drum gear 7*a* engages a gear 10*n* disposed at the shaft end of the developing roller 10*d*, and rotationally drives the developing roller 10*d*. The gear 10*n* of the developing roller 10*d* engages a gear 10*v* disposed at the shaft end of the toner transferring member 10*b* via an idler gear lot and an idler gear 10*u*, which are double-gears respectively, and transfers the rotational drive force to the toner transferring member 10*b*.

Figure 11:
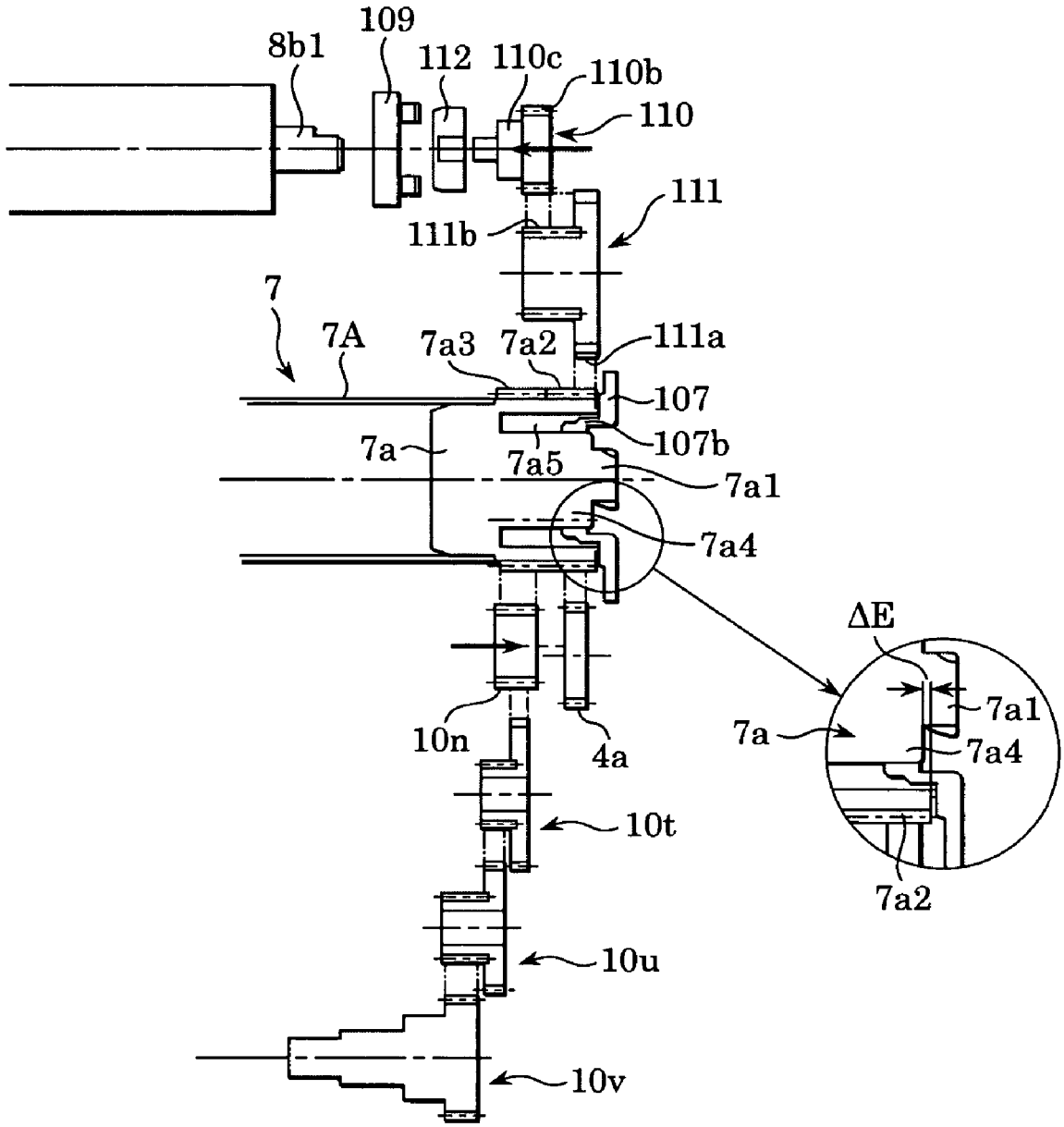
FIG. 11 is a pattern cross-sectional illustration showing a gear train of the process cartridge driving structure shown in FIG. 10.

In the present embodiment, as shown by an arrow in FIG. 11, the twisting direction of the first helical gear portion 7*a*2 of the drum gear 7*a* provides a longitudinally outward force to the developing roller 10*d* (see FIG. 10) via the gear 10*n* in order to improve positioning accuracy. The twisting direction of the second helical gear portion 7*a*3 is set to the direction which provides a longitudinally inward force to the charging roller 8 (see FIG. 10) via the joint gear 110 and the transfer roller 4 (see FIG. 10) via the gear 4*a*.

Also, in the present embodiment, the face width of the drum gear 7*a* is set to be narrower for the second helical gear portion 7*a*3 than for the first helical gear portion 7*a*2 considering the configuration of a gear driving apparatus.

In the present embodiment, the pitch diameter of the drum gear 7*a* is set to be larger for the second helical gear portion 7*a*3 than for the first helical gear portion 7*a*2.

In the present embodiment, the diameter of the photoreceptor drum 7 can be 24 mm, the diameter of the charging roller 8 can be 18 mm, and the diameter of the developing roller 10*d* can be 12 mm.

In the present embodiment, the circumferential speed of the developing roller 8 can be about 118% that of the photoreceptor drum 7, and the circumferential speed of the charging roller can be about 80% of the photoreceptor drum 7.

In the present embodiment, the abutting portion (outer peripheral surface) of the charging roller 8 is adapted to rotate in the reverse direction, and the adjacent portion (outer peripheral surface) of the developing roller 10*d* is adapted to rotate in the normal direction with respect to the photoreceptor drum 7. In other words, as shown by arrows in FIG. 1, the photoreceptor drum 7 and the charging roller 8 rotate clockwise, the developing roller 10*d* rotates counterclockwise, and the toner transfer device 10*b* rotates clockwise.

Figure 13:
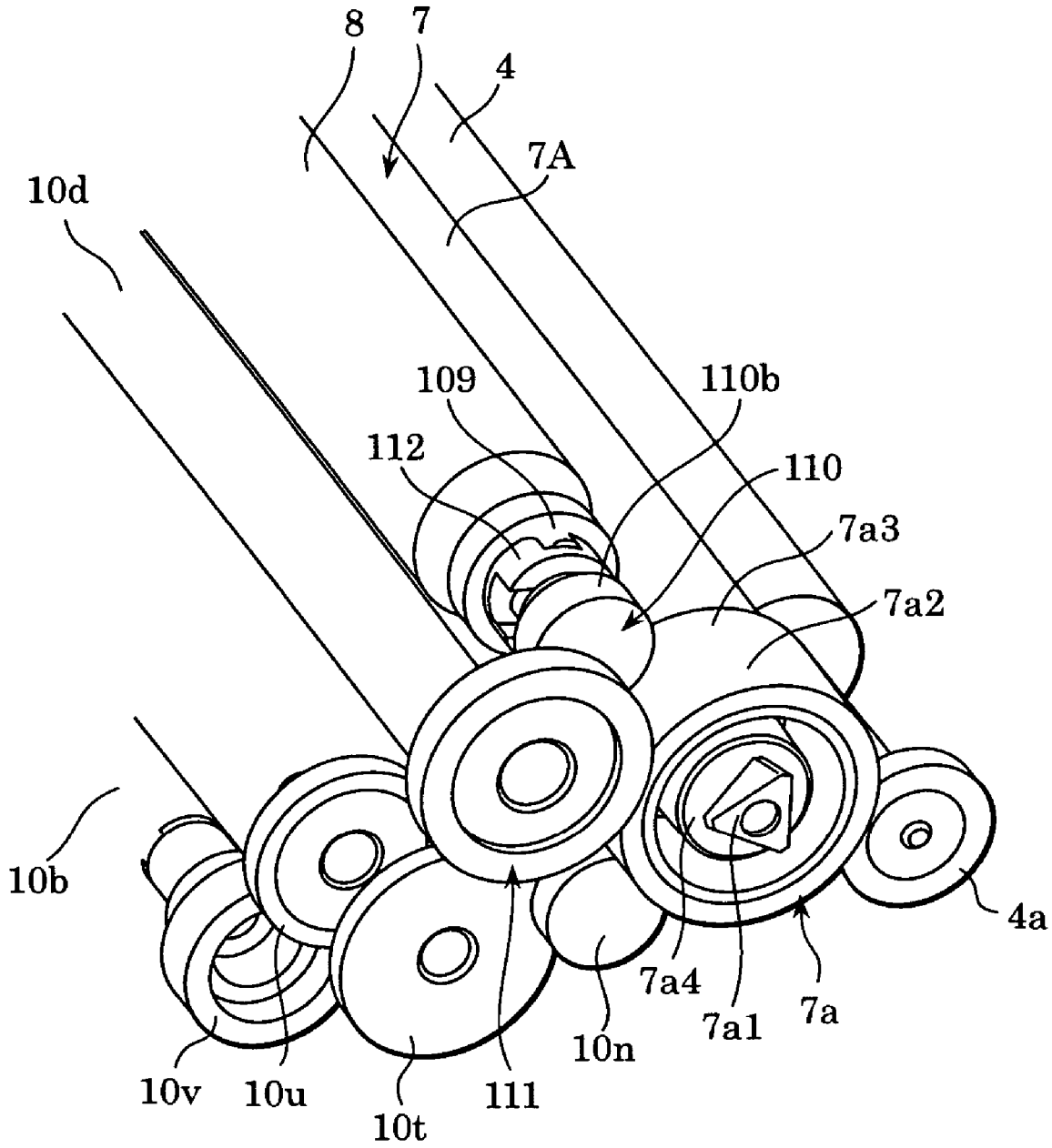
FIG. 13 is a perspective view illustrating another embodiment of the process cartridge driving structure.
Figure 14:
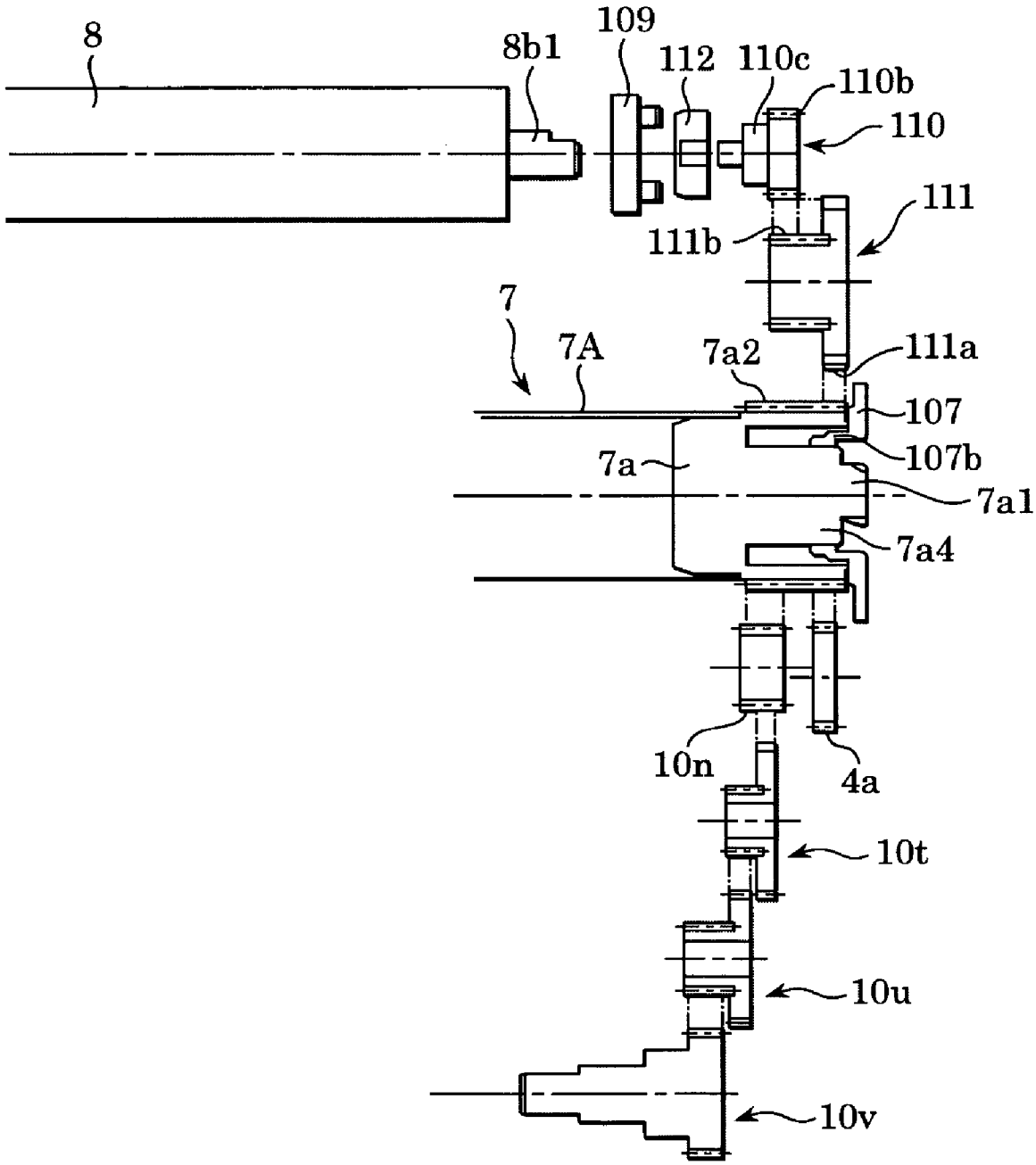
FIG. 14 is a pattern cross-sectional illustration showing a gear train of the process cartridge driving structure shown in FIG. 13.
Figure 15:
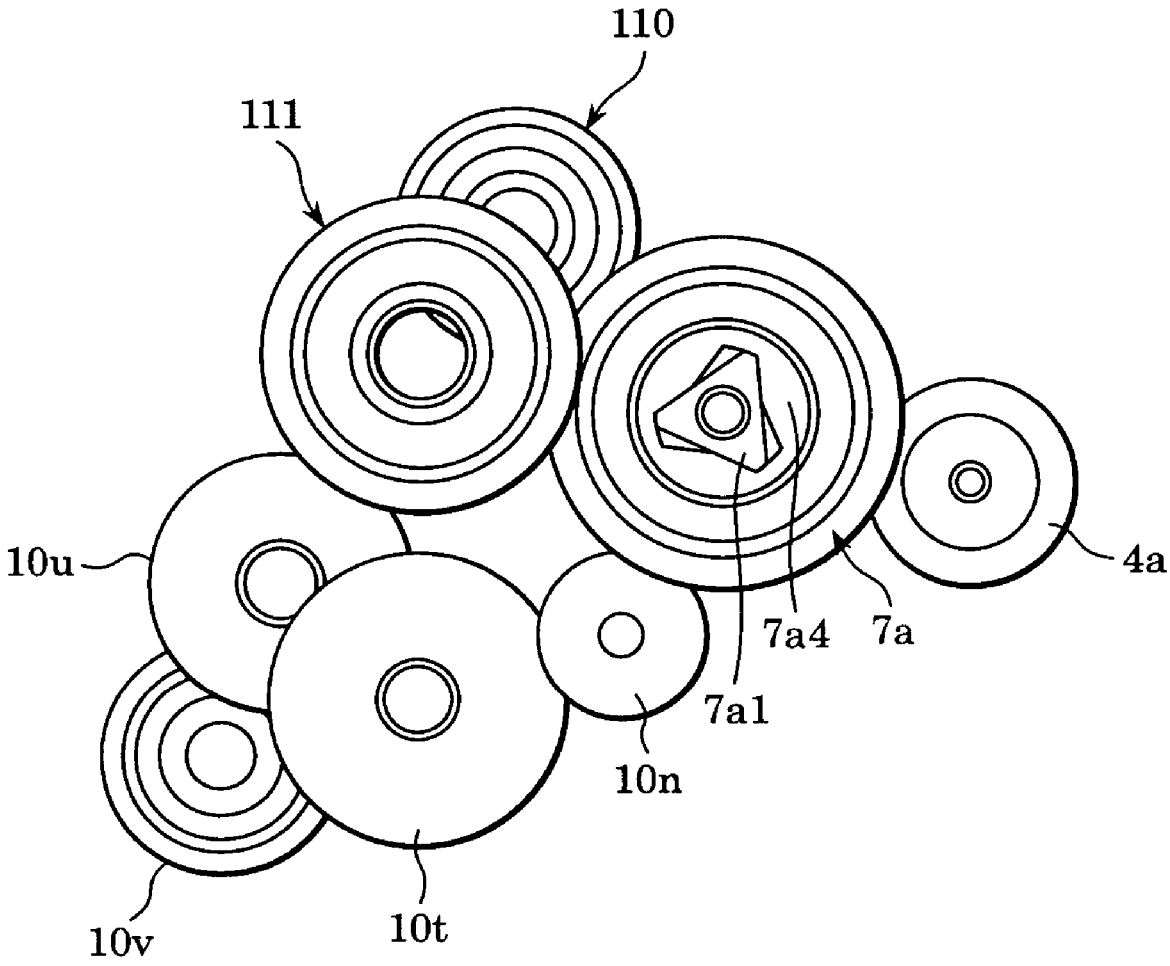
FIG. 15 is a front view illustrating the gear train of the process cartridge driving structure shown in FIG. 13.

Other embodiments of the drive gear train will be shown in FIG. 13 to FIG. 15.

Figure 12:
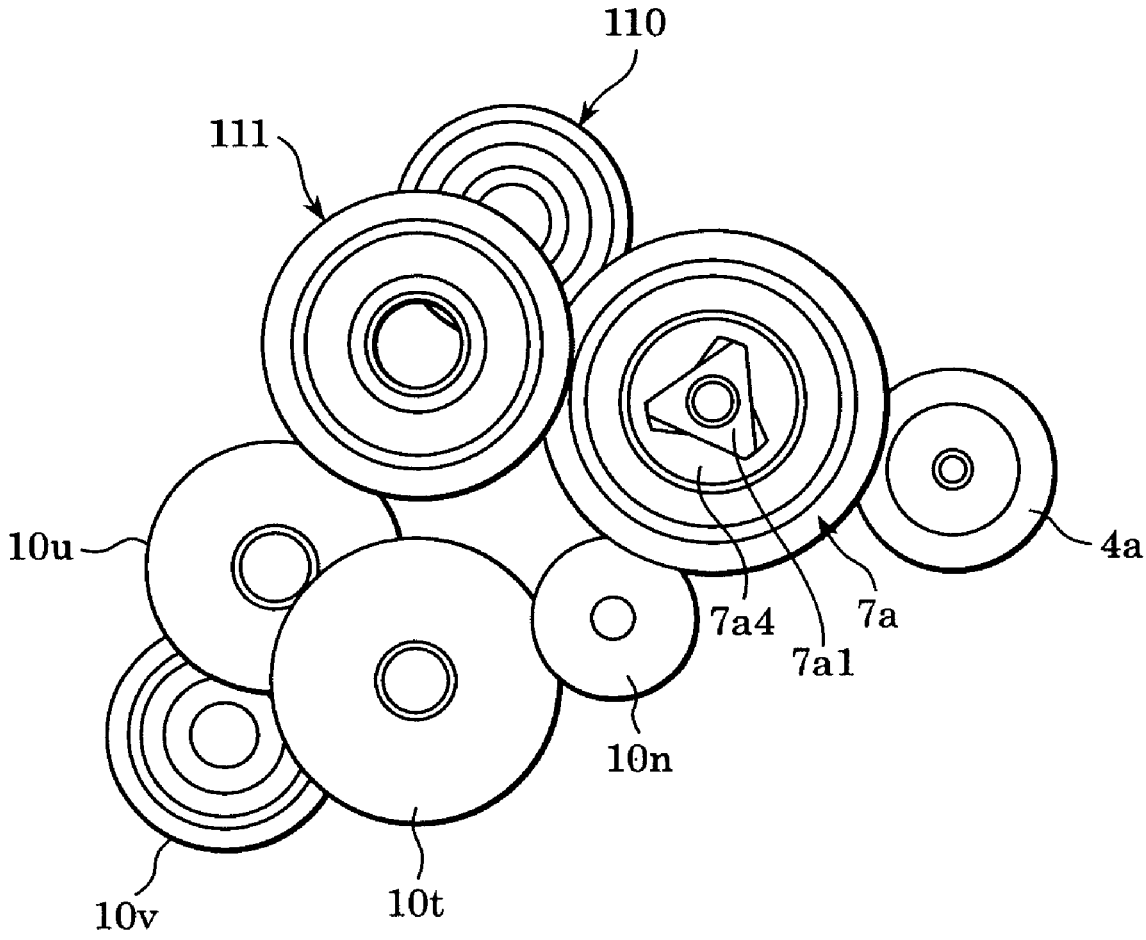
FIG. 12 is a front view illustrating the gear train of the process cartridge driving structure shown in FIG. 10.

In the drive gear train shown in FIG. 10 to FIG. 12, as described above, the drum gear 7*a* has the first helical gear portion 7*a*2 positioned outside and the second helical gear portion 7*a*3 positioned longitudinally inside the cylinder 7. While in the drive gear train shown in FIG. 13 to FIG. 15, a single helical gear (helical gear portion 7*a*2) serves as the first helical gear portion 7*a*2 and the second helical gear portion 7*a*3.

In the case of the embodiment shown in FIG. 13 to FIG. 15, the drum gear 7*a* engages the idler gear 111 and the gear 4*a* on its longitudinally outer side in the axial direction, and engages the gear 10*n* on its longitudinally inner side the axial direction.

The drive gear train shown in FIG. 10 to FIG. 12 and the drive gear train shown in FIG. 13 to FIG. 15 have the same structure except that the structure of the drum gear 7*a* is different from each other. Therefore, members having the same structure and function are represented by the same reference numerals, and description will not be made again.

Referring now to a drive gear train shown in FIG. 10 to FIG. 12, the structure of the drive gear train such as the charging roller 8, the transfer roller 4, and the developing roller 10*d* shown below will be described.

(Structure of Side Holder)

Referring now to FIG. 5 to FIG. 7, the structure of the side holder 107 will be described.

The side holder 107 includes a hole 107*a* adapted to fit on a distal end portion of a supporting shaft 102*c* of the idler gear 111 for reinforcement as described above, a bearing 107*b* for rotatably supporting the photoreceptor drum 7, and two shaft portions 107*h* for positioning with respect to the drum frame 102.

Further, the side holder 107 is formed with a through-hole 107*c* (See FIG. 5) through which an assembling tool for aligning the tooth face when engaging the drum gear 7*a* and the idler gear 111 in the assembling step.

(Assembly of Process Cartridge)

(Method of Assembling Drum Frame Unit C)

Referring again to FIG. 5, assembly of the drum frame unit C will be described.

A contact point member 113 for supplying a bias voltage to the charging roller 8 and cleaning members 114 (114*a*, 114*b*) at the ends of the drum are built in the drum frame 102. The cleaning members 114 will be described later.

The shaft portions 8*b*1, 8*b*2 of the charging roller 8 are rotatably supported by the bearing members 103*a*, 103*b* at both ends as described above. The shaft portion 8*b*2 on the side of the contact point member 113 joins the bearing 103*a* (formed of conductive plastic) and the spring 104 for pressurizing the charging roller 8 to the photoreceptor drum 7 and is built in the drum frame member 102. The shaft portion 8*b*1 on the side of the non-contact point member joins the bearing 103*b* (formed of conductive plastic) and the spring 104 for pressurizing the charging roller 8 to the photoreceptor drum 7 and is built in the drum frame member 102.

A joint 109, which is a drive force receiving portion described later, and an intermediate joint 112, which is an intermediate driving force transmitting member, are fitted in this order to one end of the shaft portion 8*b*1 of the charging roller 8, and are fitted to the bearing members 103*a*, 103*b* with the shaft portion 8*b*1 of the charging roller 8 positioned on the non-contact point side, and the shaft portion 8*b*2 on the contact point side.

The conductive fine particles described above are applied on the charging roller 8 in advance.

The joint gear 110 is assembled into a hole 108 on the drum frame 102 with the phase of the joint portion of the joint gear 110, which is a drive force transmitting member, aligned with an elongated hole of the intermediate joint 112.

The idler gear 111 is fitted to the supporting shaft 102*c* of the drum frame 102 while engaging the joint gear 110.

The photoreceptor drum 7 is placed at a predetermined position with respect to the drum frame 102 using a tool. The side of the photoreceptor drum 7 opposite from the drum gear is fitted by fixing a drum supporting shaft 100 to the drum frame 102 and fitting the flange of the photoreceptor drum 7 thereto, while the drum gear side 7*a* is positioned with respect to the drum frame 102 by fitting the side holder 107 into the supporting and sliding hole 107*b* of the drum gear 7*a*. In this case, the first drum is assembled while adjusting engagement between the first drum helical gear portion 7*a*2 and the idler gear 111, and is secured by a screw.

With the above-described process, the drum frame unit C is completed.

(Method of Assembling Developing Device 10 and Developing Unit D)

Subsequently, referring to FIG. 2, FIG. 16 to FIG. 20, the developing unit D and the developing device 10 constituting the process cartridge B will be described in detail.

Figure 17:
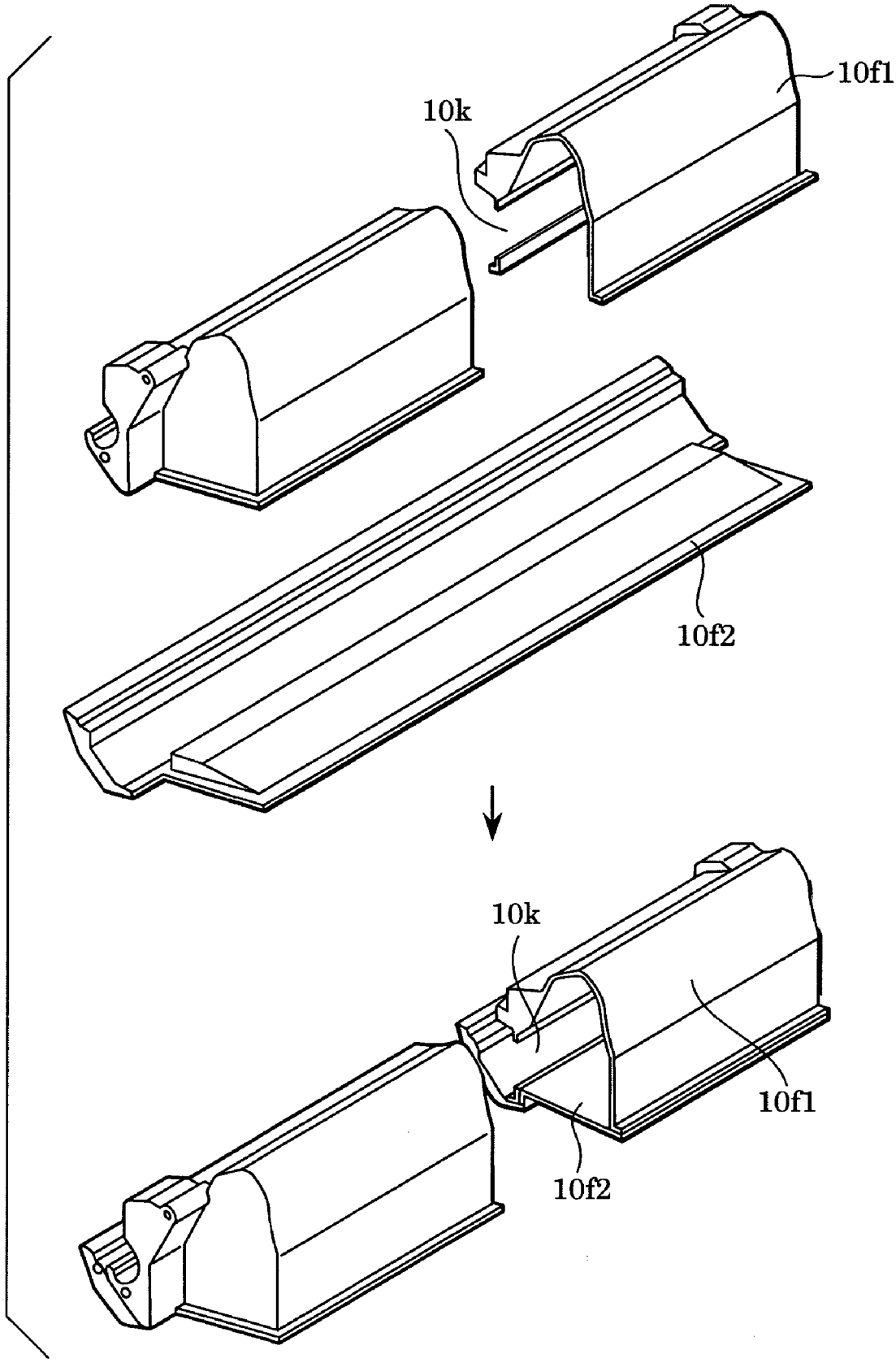
FIG. 17 is a perspective view illustrating the connecting state between a toner developing frame and a lid member constituting a cartridge according to an embodiment of the invention.

As shown in FIG. 2 and FIG. 17, the developing device 10 includes the toner developing frame 10*f*1 and the lid member 10*f*2 joined to each other and defines the toner chamber (toner storage) 10*a* and a developing chamber 10*i*.

The toner developing frame 10*f*1 is formed with the toner passing opening 10*k* through which toner stored in the toner chamber 10*a* passes through when being fed to the developing roller 10*d*.

Figure 16A:
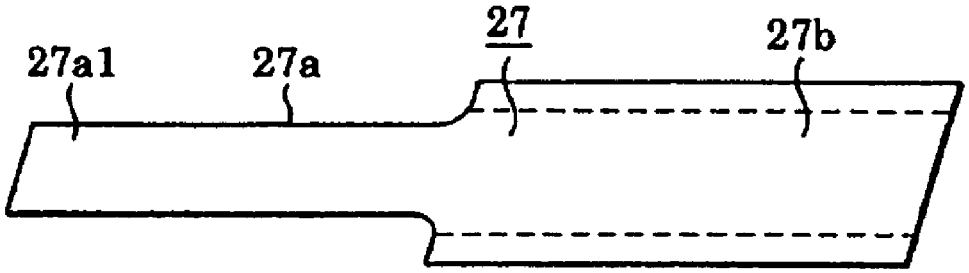
FIG. 16A is a perspective view of an embodiment of a toner sealing member and FIG. 16B is a cross-sectional view of the toner sealing member.
Figure 16B:
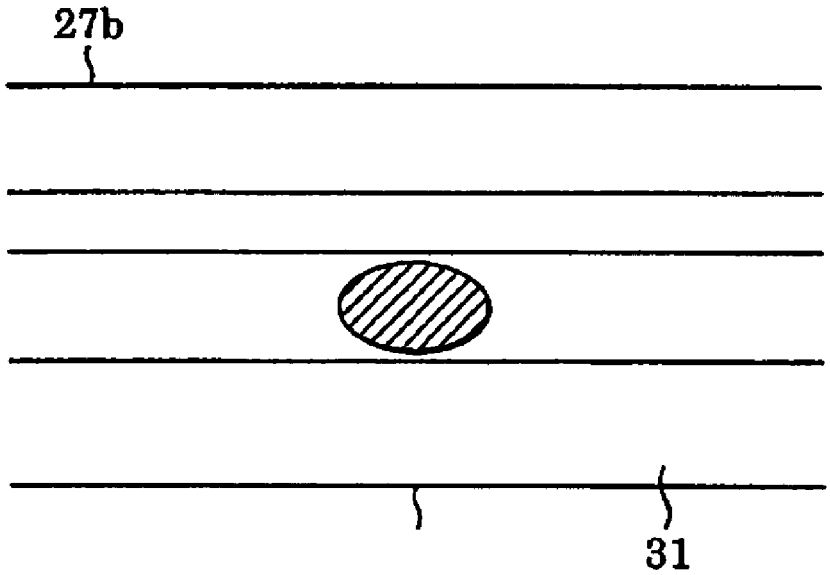

As shown in FIGS. 16A and 16B, a toner sealing member 27 includes a plurality of layers, and is intended to cover the toner passing opening 10*k* on the toner developing frame 10*f*1. A tearable cover film portion 27*b* is hot-welded to a seal attaching portion of the toner sealing member 27. The cover film portion 27*b* is provided with an adhesive layer 31, which can be heat-welded, for fixing the toner sealing member 27. Further detailed structure of the toner sealing member is known by those skilled in the art, and, for example, is disclosed in Japanese Patent Laid-Open No. 11-102105 (corresponding U.S. Pat. No. 6,118,957 A), which is incorporated by reference herein. For detailed information, refer to the above-described publication.

Figure 18:
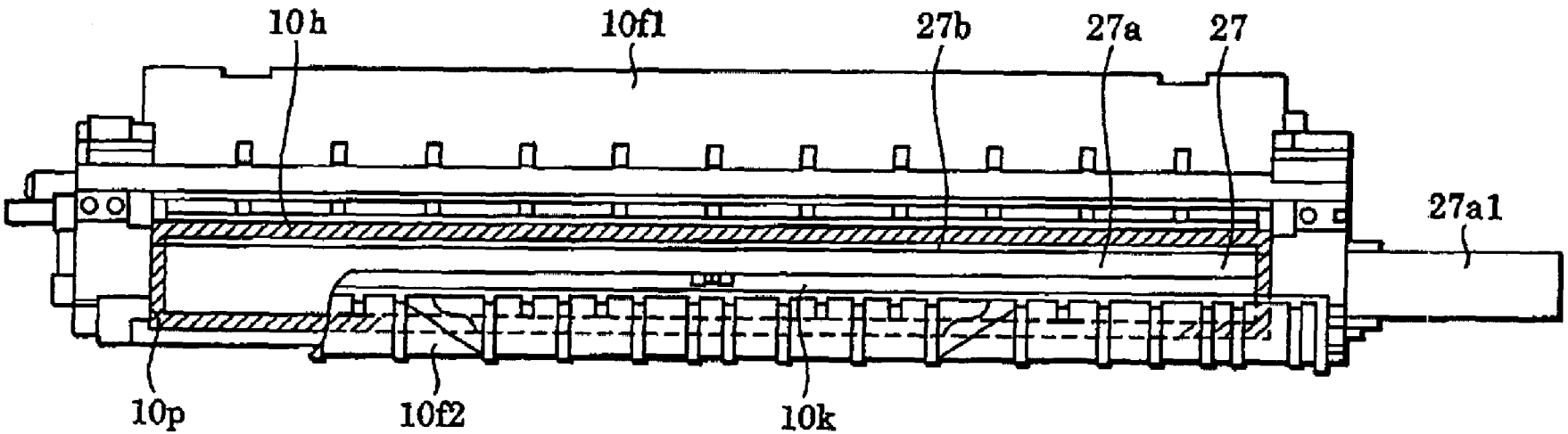
FIG. 18 is a drawing showing the connecting state of the toner sealing member to the toner developing frame.

The toner sealing member 27 is adhered to a seal attaching portion 10*h* extending along the four sides of the toner passing opening 10*k*, as shown in FIG. 18. The toner sealing member 27 is applied with half-cut processing by laser for opening the toner passing opening 10*k* (Japanese Patent Laid-Open No. 11-102105).

Figure 19:
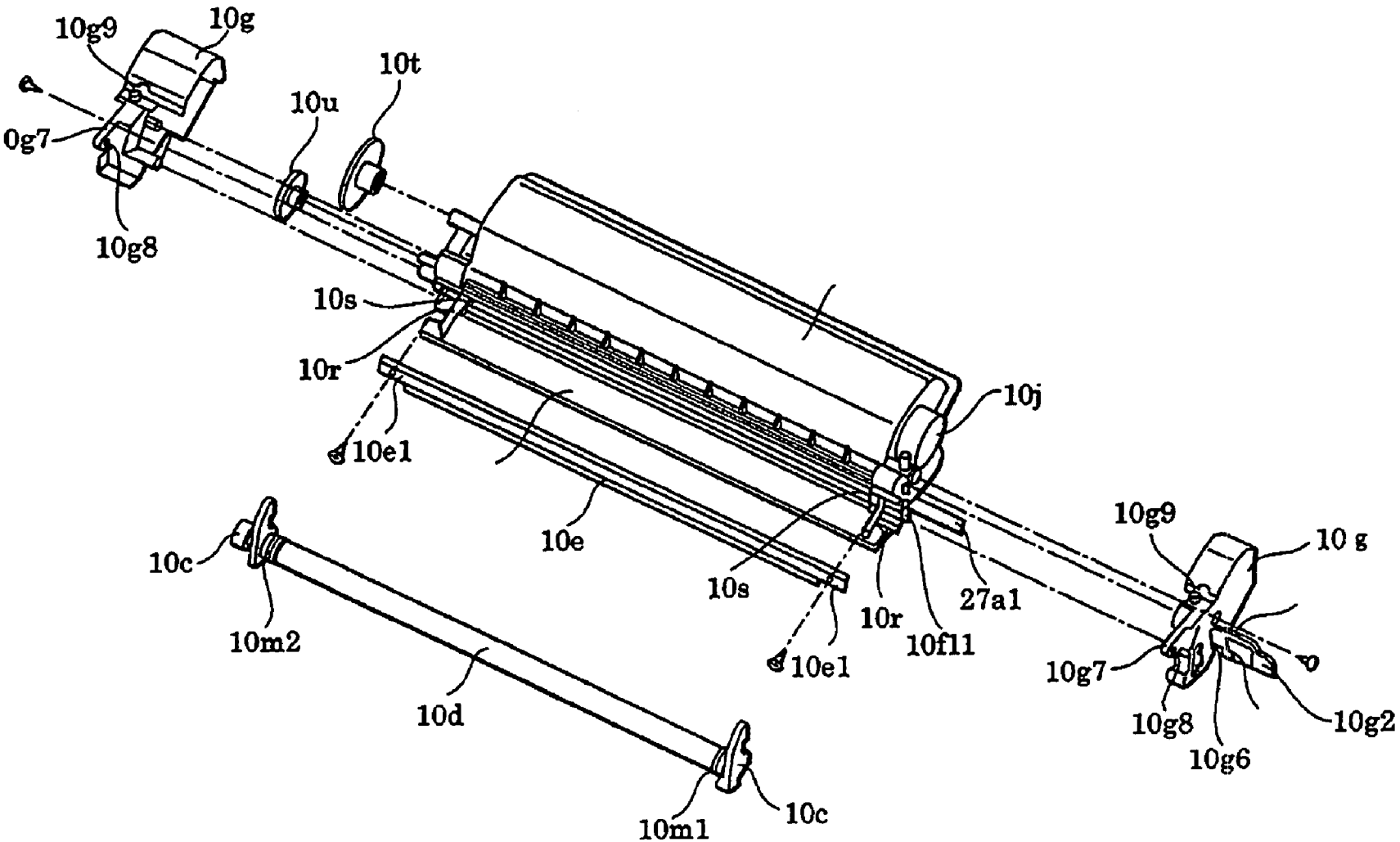
FIG. 19 is an exploded perspective view of a developing unit of the process cartridge of the invention.

A toner filling port (not shown) for filling toner in the toner chamber 10*a* is provided at the end of the toner developing frame 10*f*1 in the longitudinal direction, and is sealed by a cap member 10*j* after toner is filled (See FIG. 19).

Referring to FIG. 18 and FIG. 19, an assembling process of the developing unit D will be described.

The developing device 10 includes an end seal 10*r* for preventing leakage of toner from both ends of the developing roller 10*d*, a sealing member 10*s* for preventing leakage of toner from both ends of the developing blade 10*e*, and a seat member for preventing toner from flying in all directions from the clearance at the lower portion of the developing roller 10*d* attached to the toner developing frame 10*f*1 and the lid member 10*f*2 by double-sided adhesive tape or the like.

The developing blades 10*e* are fixed to the toner developing frame 10*f*1 by screws at both ends of a plate metal portion 10*e*1.

One (left side in FIG. 19) of end members (holder member) 10*g* disposed on both ends in the longitudinal direction of the developing device 10 covers a gear train including the developing roller gear 10*n* (See FIG. 10 and FIG. 11) fixed to an end of the developing roller 10*d*, which engages the drum gear 7*a*3 (see FIG. 5) fixed to the end of the photoreceptor drum 7, and two idler gears 10*u*, 10*t* for transmitting a drive force from the developing roller gear 10*n* to a transfer gear (not shown) of the toner transferring member 10*b*.

A drawer portion 27*a* (see FIG. 16A) of the toner sealing member 27 is folded back at one end 10*p* in the longitudinal direction of the toner passing opening 10*k* (See FIG. 18), and pulled outward through a hole 10*f*11 (See FIG. 19) of the toner developing frame 10*f*1.

An end 27*a*1 pulled outward of the drawer portion 27*a* of the toner sealing member 27 is further pulled out through a hole 10*g*6 of the end member 10*g* (See FIG. 19).

Figure 20:
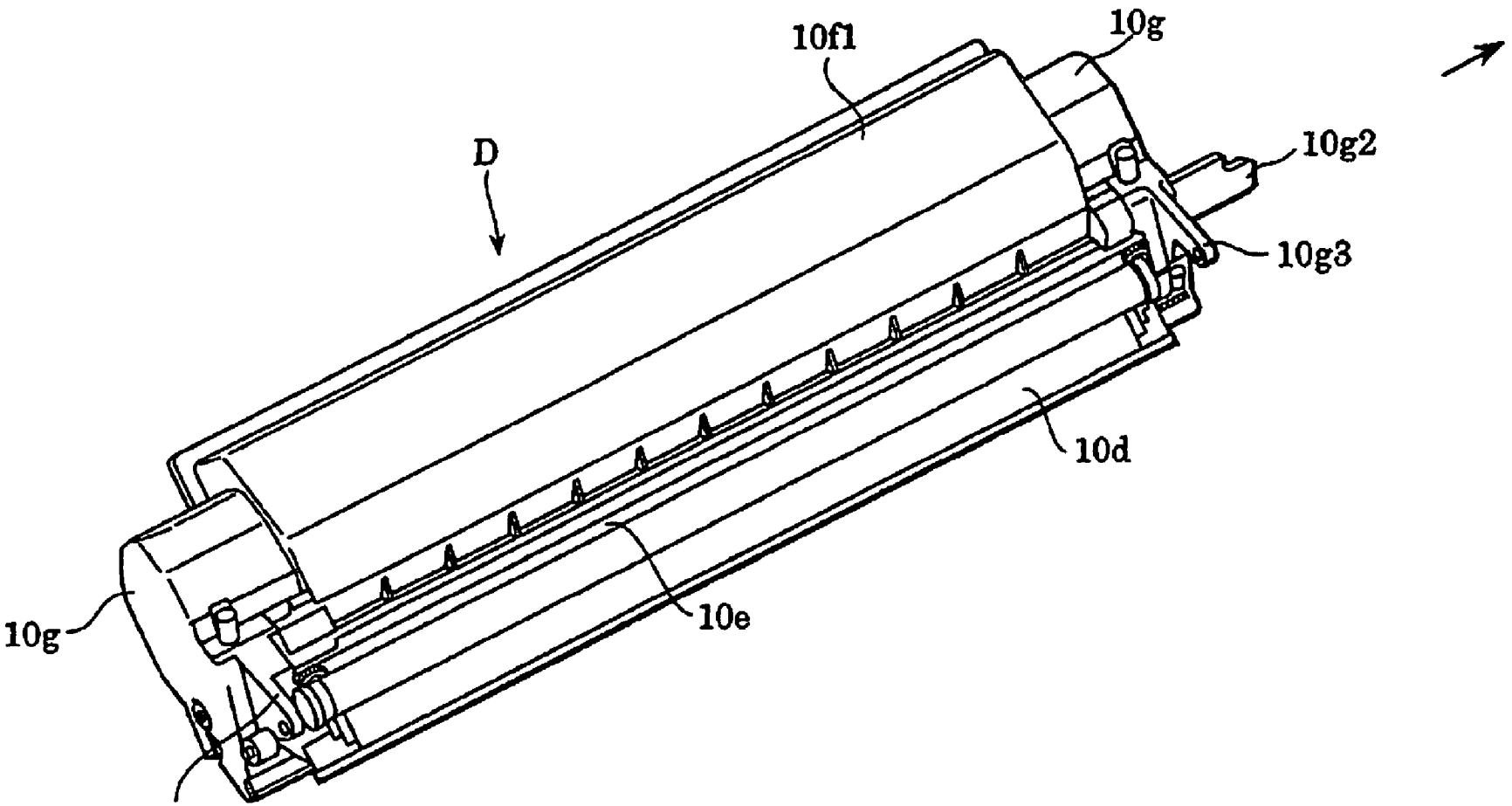
FIG. 20 is a perspective view of the developing unit shown in FIG. 19.

With the process described above, the developing unit D is completed as shown in FIG. 20.

As shown in FIG. 19, an arm 10*g*7 projects from the end member log toward the drum frame 102, and the drum frame 102 and the end member log can be rotatably joined by a pin (not shown) fitted into a joint hole 10*g*8 extending in the longitudinal direction formed at the distal end of the arm 10*g*7 and a joint hole, not shown, formed on the drum frame 102. The compression coil spring fitted at its inner periphery on a spring stop 10*g*9 on the arm 10*g*7 is provided in a space defined by the drum frame 102 in a contracted state, and spacing retaining members provided at both ends of the developing roller 10*d*, that is, space retaining members (spacers) 10*m* (10*m*1, 10*m*2) is compressed against the peripheral surface of the photoreceptor drum 7. Consequently, a predetermined distance is retained between the developing roller 10*d* and the peripheral surface of the photoreceptor drum 7.

Figure 21:
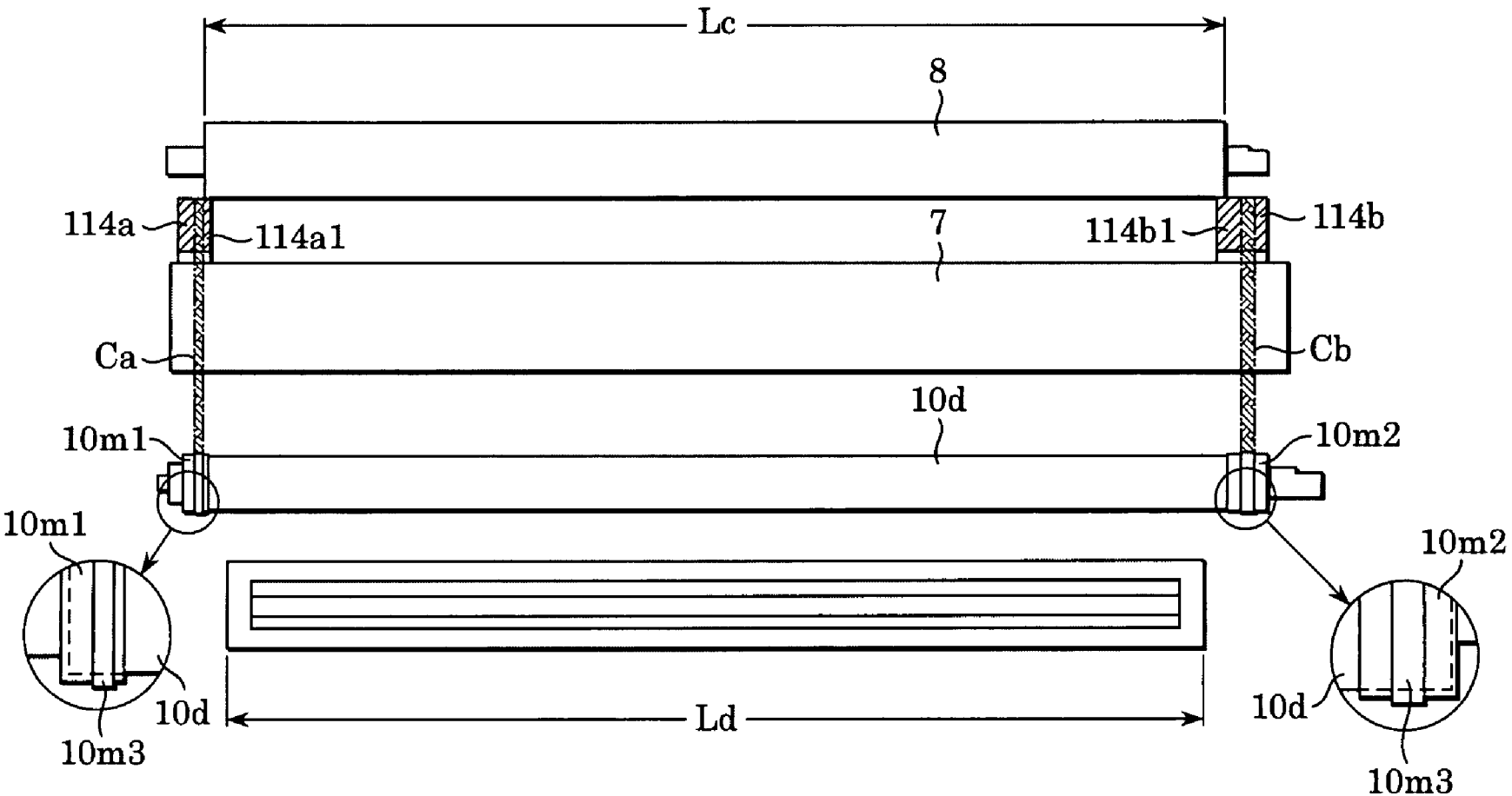
FIG. 21 is an illustration showing a mounting state of a cleaning member in the process cartridge of the invention.

In the present embodiment, the spacing retaining members 10*m* are provided with cap-shaped cap rollers fitted and fixed at both ends of the developing roller 10*d*, as shown in FIG. 19 and FIG. 21. The cap rollers 10*m* are, as most clearly shown in FIG. 21, provided with an annular projection 10*m*3 projected outward in a predetermined width in a convex shape at part of the peripheral surface. The annular projection 10*m*3 is brought into press-contact with the peripheral surface of the photoreceptor drum 7.

In a manner described above, the developing unit D and the drum frame unit C are joined integrally with each other and the process cartridge is completed.

(Structure of Cleaning Member 114)

There may be a case in which a slight amount of toner suspends in the image forming apparatus body A0 when a toner image is transferred from the photoreceptor drum 7 to the recording medium 2, or during the period up to when the recording medium 2 enters into the fixing device 5.

Such suspending toner is, when attached to the photoreceptor drum 7, brought into press contact with the portion in which the cap roller 10*m* abuts by a spring force urging the developing roller 10*d* toward the photoreceptor drum 7, and hence may be fixed on the surface of the photoreceptor drum. The fixed toner grows little by little until the process cartridge reaches the end of its lifetime, and hence may exist as a block of toner at the abutting portion of the photoreceptor drum 7 abutting the cap roller 10*m*.

When the toner block is attached to the abutting portion of the photoreceptor drum 7 with respect to the cap roller 10*m*, the distance between the photoreceptor drum 7 and the developing roller 10*d* may vary, which may cause problems with developability of the latent image on the photoreceptor drum 7 by toner, or may cause vibrations by the developing roller 10*d* climbing over the toner block. Therefore, random variations in pitch may occur normal to the transferring direction of the recording medium 2.

Accordingly, in the present embodiment, at the portion to which the cap roller 10*m*, the separate cleaning members 114 (114*a*, 114*b*) coming into contact with the peripheral surfaces on the left and right ends in the longitudinal direction of the photoreceptor drum 7 as will be understood when referring to FIG. 2 and FIG. 5 for removing toner attached to the photoreceptor drum 7 are attached to the drum frame 102 with double-faced adhesive tape or the like.

The cleaning member 114 can be:

(1) a layered structure formed by fixing a non-woven fabric on a resilient member formed on foam polyurethane layers or felt layers;
(2) a layered structure formed by further fixing a felt layer as a toner removing layer on resilient member formed of form polyurethane layers or felt layers;
(3) a layered structure formed by fixing a pile fabric on a resilient member formed of foam polyurethane layers or felt layers;
(4) those fixed with high-density polyurethane on part of form polyurethane;
(5) felt;
(6) form polyurethane; or
(7) non-woven fabric.

In the case of the layered structure as stated above-described (1), (2) and (3), it is disposed so that non-woven fabric, the felt layer as a toner removing layer, or the pile fabric comes into contact with the photoreceptor drum 7.

These cleaning members 114 can reduce a sliding resistance as much as possible to prevent increase is a drive force (rotational drive force) of the photoreceptor drum 7, and can ensure trapping of suspending toner attached on the surface of the photoreceptor drum within the non-woven fabric or the like without allowing it to be fallen into the main body of the apparatus, whereby the toner on the photoreceptor drum can be removed satisfactorily.

Referring now to FIG. 21, the positional relation among the cleaning members 114 attached to the drum frame, the photoreceptor drum 7, and the charging roller 8 will be described.

When the suspending toner described above is attached outside the uncharged area on the photoreceptor drum, that is, the charging roller contact area, it may cause toner stain on the edge of the image or at the end of the sheet.

As shown in FIG. 21, in the present embodiment, the cap rollers 10*m* (10*m*1, 10*m*2) as space retaining members are disposed at the ends of the developing roller 10*d*. These cap rollers 10*m*, that is, the annular projections 10*m*3 of the cap rollers 10*m* are in press contact with the peripheral surface of the photoreceptor drum. The cleaning members 114 (114*a*, 114*b*) are disposed at a distance from each other corresponding to the cap rollers 10*m* (10*m*1, 10*m*2).

In other word, in FIG. 5 and FIG. 21, in the longitudinal direction of the photoreceptor drum 7, the first cleaning member 114*a* provided in contact with the left peripheral surface of the photoreceptor drum 7 is disposed in an area Ca, in which the cap roller 10*m*1 as the space retaining member of the developing roller 10*d* is in contact with the peripheral surface of the photoreceptor drum 7. Furthermore, in the longitudinal direction of the photoreceptor drum 7, an inner edge 114*a*1 of the first cleaning member

114*a* is positioned outside a developing area Ld of the developing roller 10*d* as well as inside the contact area Lc in which the charging roller 8 is in contact with the photoreceptor drum 7, in other words, within the contact area Lc.

In the same manner, in FIG. 5 and FIG. 21, in the longitudinal direction of the photoreceptor drum 7, the second cleaning member 114*b* provided in contact with the right peripheral surface of the photoreceptor drum 7 is disposed in a contact area Cb, in which the cap roller 10*m*2 as the space retaining member of the developing roller 10*d* is in contact with the peripheral surface of the photoreceptor drum 7. Furthermore, in the longitudinal direction of the photoreceptor drum 7, an inner edge 114*b*1 of the second cleaning member 114*b* is positioned outside the developing area Ld of the developing roller 10*d* as well as inside the contact area Lc, in which the charging roller 8 is in contact with the photoreceptor drum 7, in other words, within the contact area Lc.

In this arrangement, toner attached to the photoreceptor drum 7 can be trapped and removed by the first and the second cleaning members 114*a*, 114*b*.

Therefore, toner block is prevented from being formed at the abutting portion between the photoreceptor drum 7 and the cap rollers 10*m* (10*m*1, 10*m*2). Therefore, the distance between the photoreceptor drum 7 and the developing roller 10*d* can be maintained constantly, and hence satisfactory images can be formed on the recording medium 2.

In particular, when the layered structure including a resilient member and a non-woven fabric is employed, attachment of toner to the abutting position of the photoreceptor drum 7 with respect to the cap rollers 10*m* can be prevented without increasing the number of components, and simultaneously, its elasticity is increased. Therefore, improvement of assembleability is enabled, whereby a satisfactory image can be formed while restricting increase in cost of the process cartridge B.

Also, the first and second cleaning members 114*a*, 114*b* can clean toner attached to an uncharged area on the photoreceptor drum, that is, outside the charging roller contact area, and hence a satisfactory image can be obtained while preventing attachment of toner to the edge of the image of the end of the sheet.

Although the cleaning members 114(114*a*, 114*b*) of the present embodiment are provided at both ends in the longitudinal direction of the photoreceptor drum 7, it is also applicable to provide the same only at either end thereof.

(Attachment and Detachment of Process Cartridge B to Main Body of Image Forming Apparatus)

The process cartridge B assembled as described above is attached to the image forming apparatus body A0 for forming an image. The state of attachment will be described referring to FIG. 22 to FIG. 27.

As shown in FIG. 20, when a handle 10*g*2, which corresponds to an end member, is cut off from the developing unit D of the process cartridge B, and pulled with the toner sealing member 27 in the direction indicated by an arrow, toner is supplied to the developing chamber 10*i* and then the process cartridge is prepared.

Figure 4:
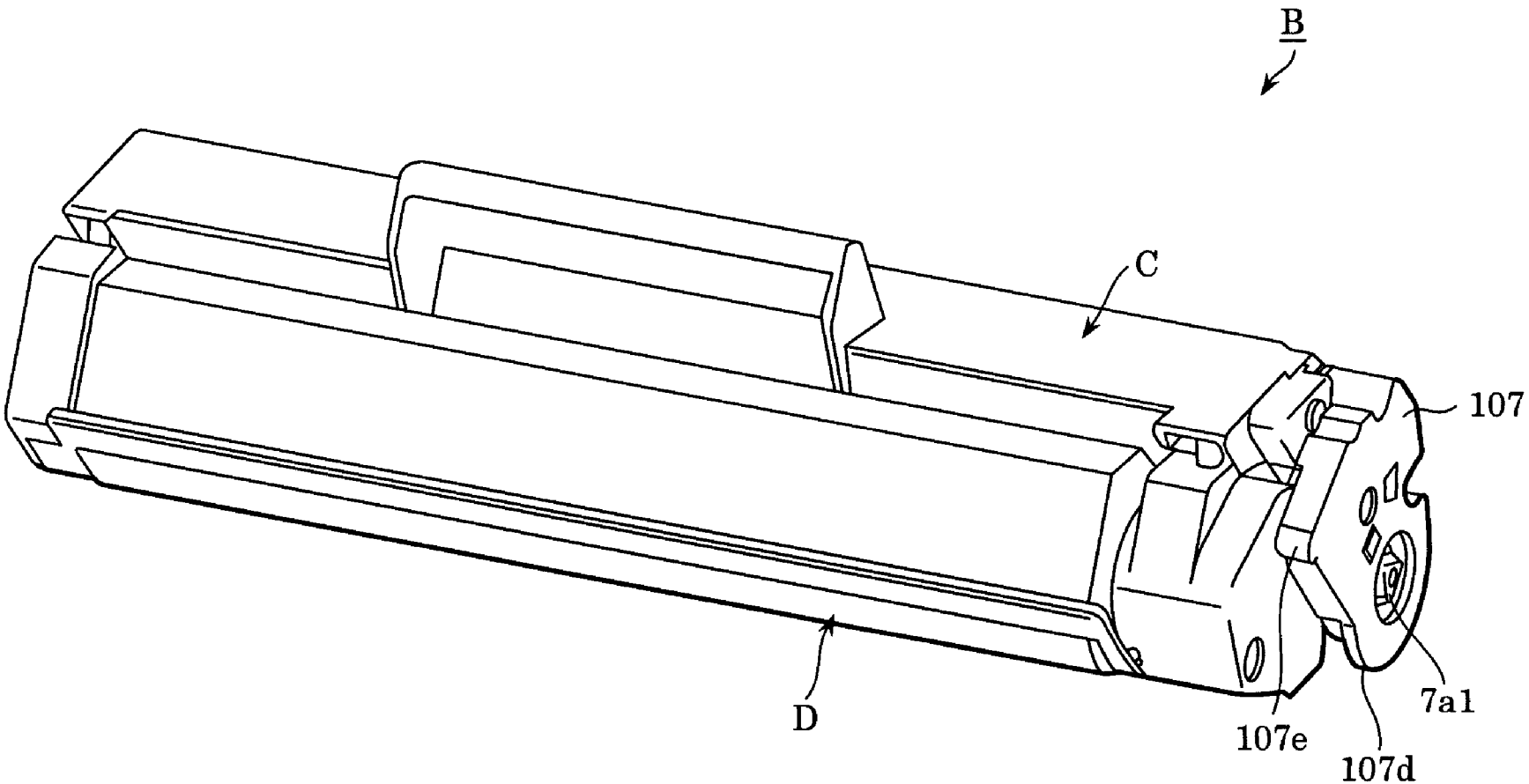
FIG. 4 is a perspective view of the process cartridge shown in FIG. 2.

As will be understood when referring also to FIG. 4, the side holder 107 to be attached to the cartridge frame (drum frame 102) of the process cartridge B is provided with an arcuate portion (first abutting portion) 107*d* formed coaxially with the drum center shaft, and a rotation stopper (second abutting portion) 107*e* formed into an arcuate shape located at the corner of the side holder 107 and formed on the bottom surface of the cartridge frame for controlling the position as a mounting guide to the image forming apparatus body A0.

The arcuate portion 107*d* is positioned outside the developing unit D in the direction of the drum axis of the developing unit D, and is disposed at least partly with the developing unit D in cross section. The rotation stopper 107*e* is positioned outside the developing unit D, and is formed so as to overlap with the photoreceptor drum 7 of the developing unit D entirely in the axial direction. The rotation stopper 107*e* is disposed behind the arcuate portion 107*d* in the direction of insertion.

Figure 28:
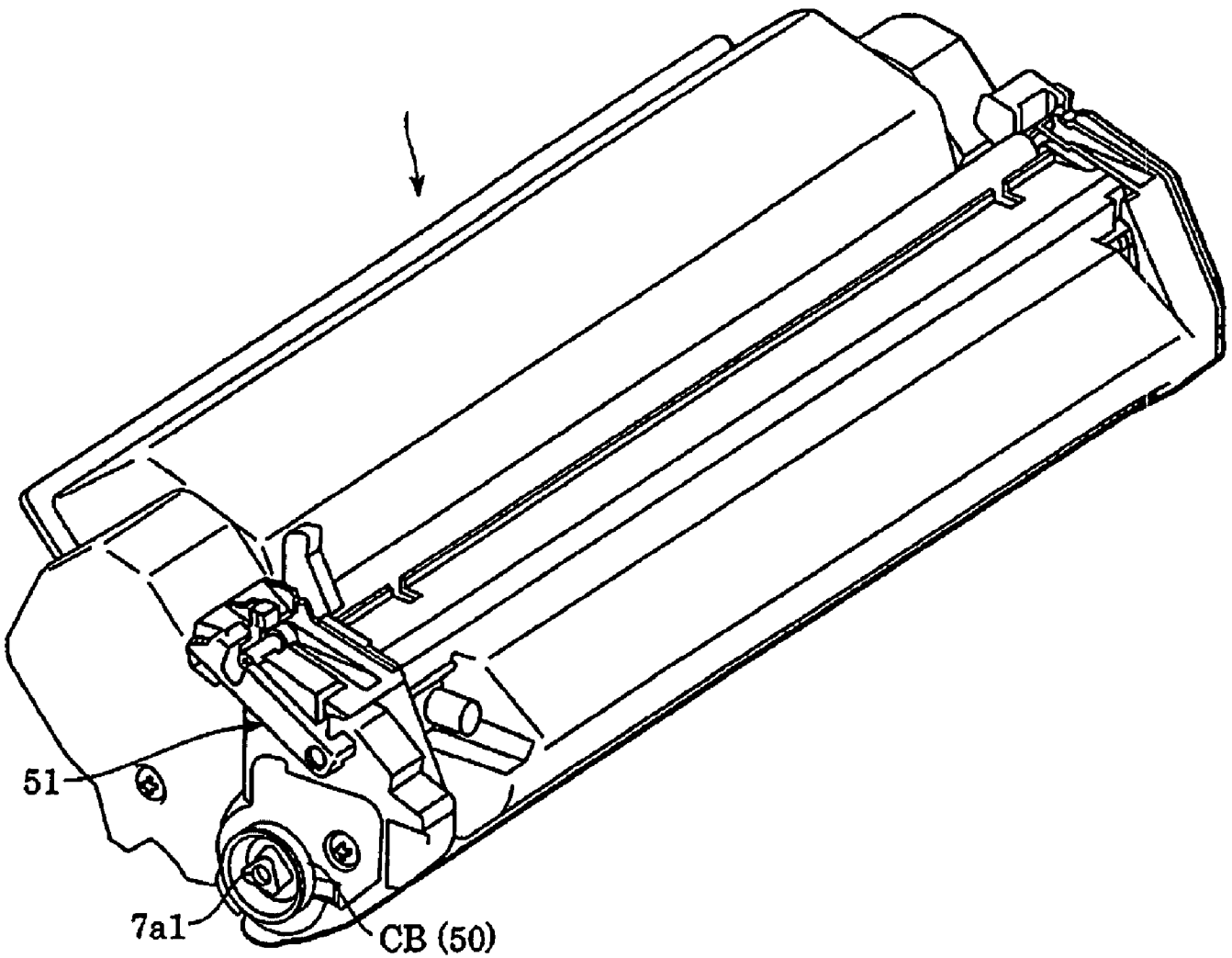
FIG. 28 PRIOR ART
FIG. 28 is a perspective view of a process cartridge in the related art.
Figure 29:
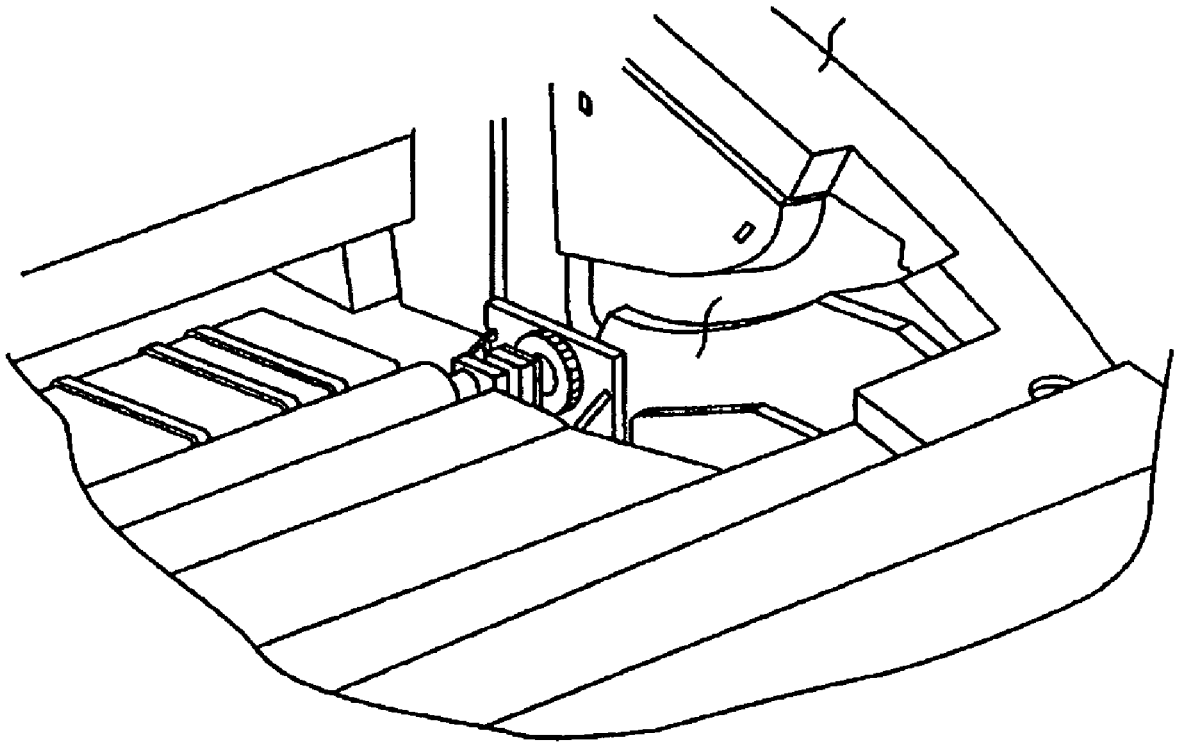
FIG. 29 is a perspective view showing a process cartridge mounting guide in an image forming apparatus in the related art.
Figure 30:
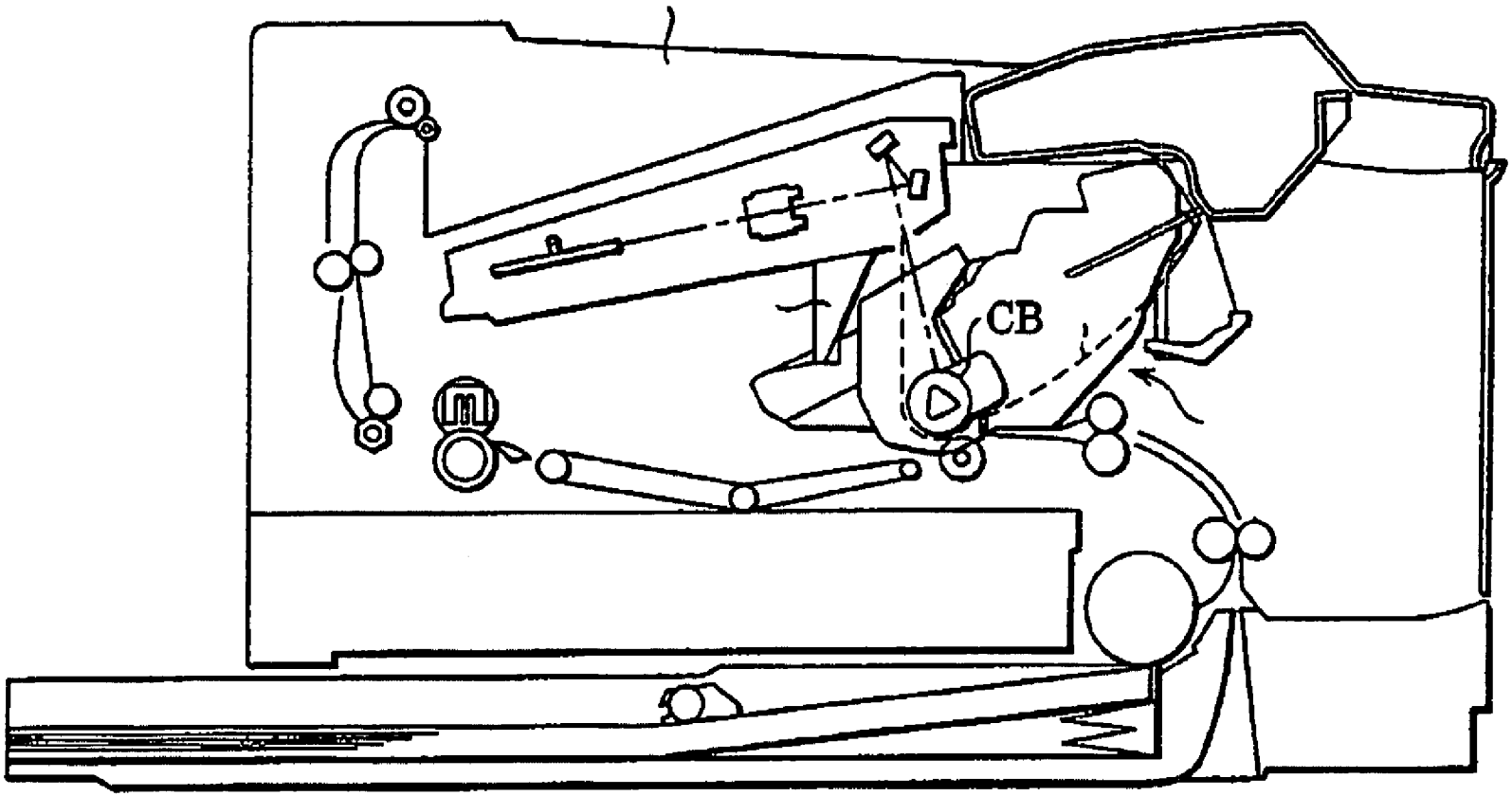
FIG. 30 is a schematic block diagram of the image forming apparatus provided with the process cartridge in the related art.

According to the present embodiment, the triangular coupling member 7*a*1, which receives a drive force from the image forming apparatus body A0, is disposed inside the side holder 107 in the direction of drum axis. Accordingly, as the process cartridge in the related art shown in FIG. 28, it is necessary to from a cover portion 50 of the triangular coupling member 7*a*1, which also serves as a positioning boss CB, and a projection 51 as the guide any longer, and hence the cartridge can be downsized more than in the related art.

Figure 22:
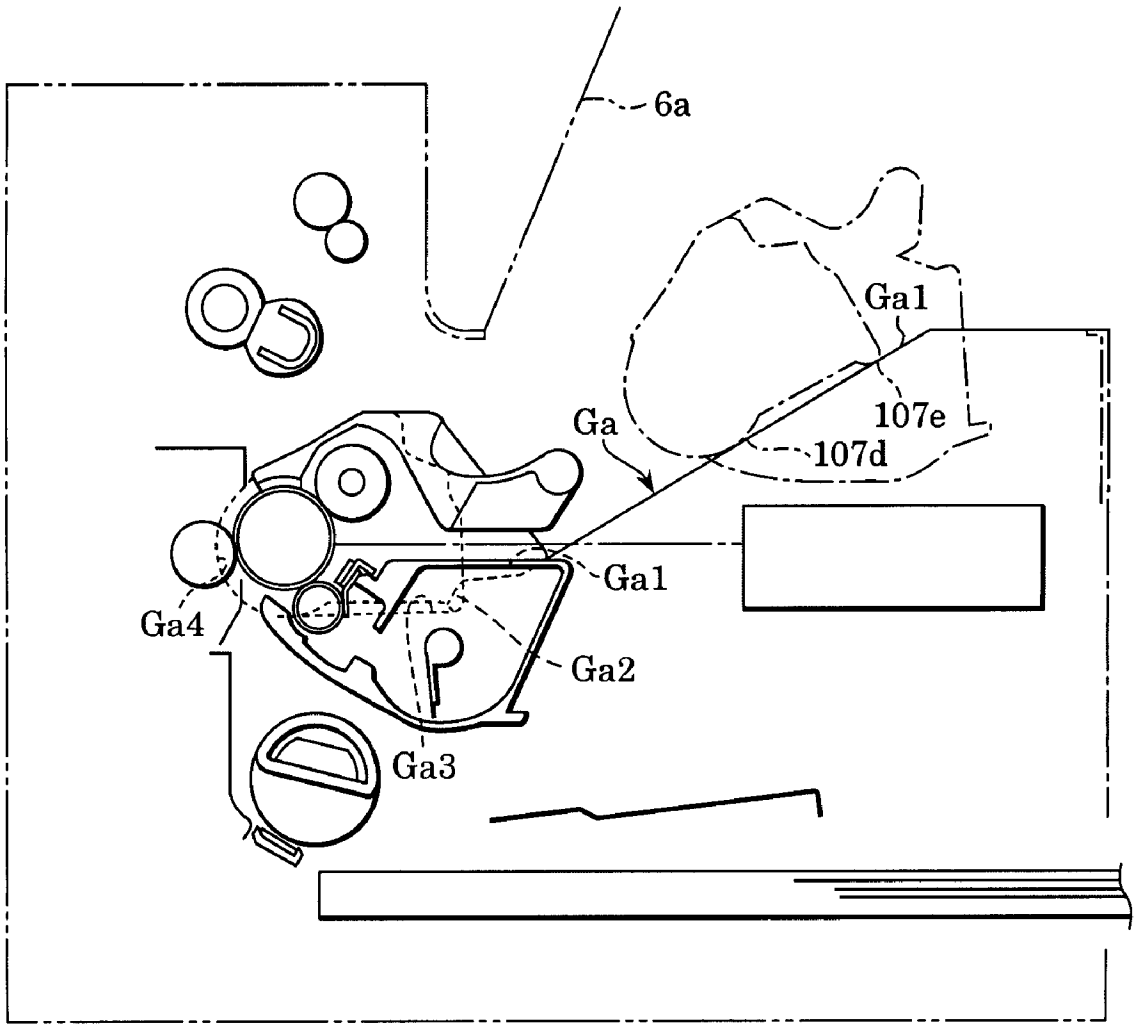
FIG. 22 is an explanatory pattern cross-sectional illustration of the image forming apparatus showing the state of mounting the process cartridge to the image forming apparatus.
Figure 24:
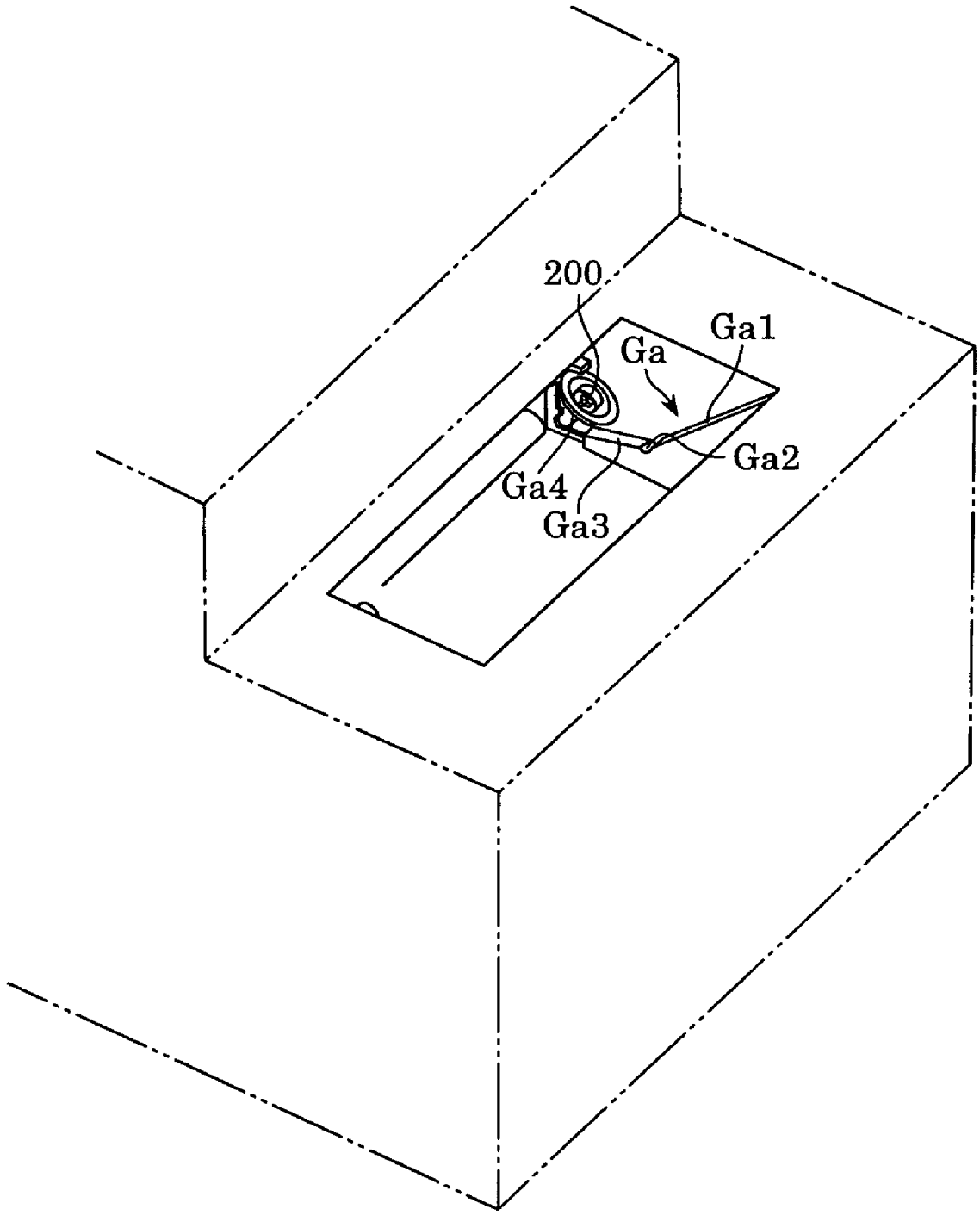
FIG. 24 is a perspective view showing a process cartridge mounting guide of the image forming apparatus according to the invention.

The image forming apparatus body A0 is, as shown in FIG. 22 and FIG. 24, formed with a guide member Ga as a first body guide, which guides the process cartridge B to the image forming position (attached position) while sliding the aforementioned two arcuate positions 107*d* and the rotation stopper 107*e*.

Figure 3:
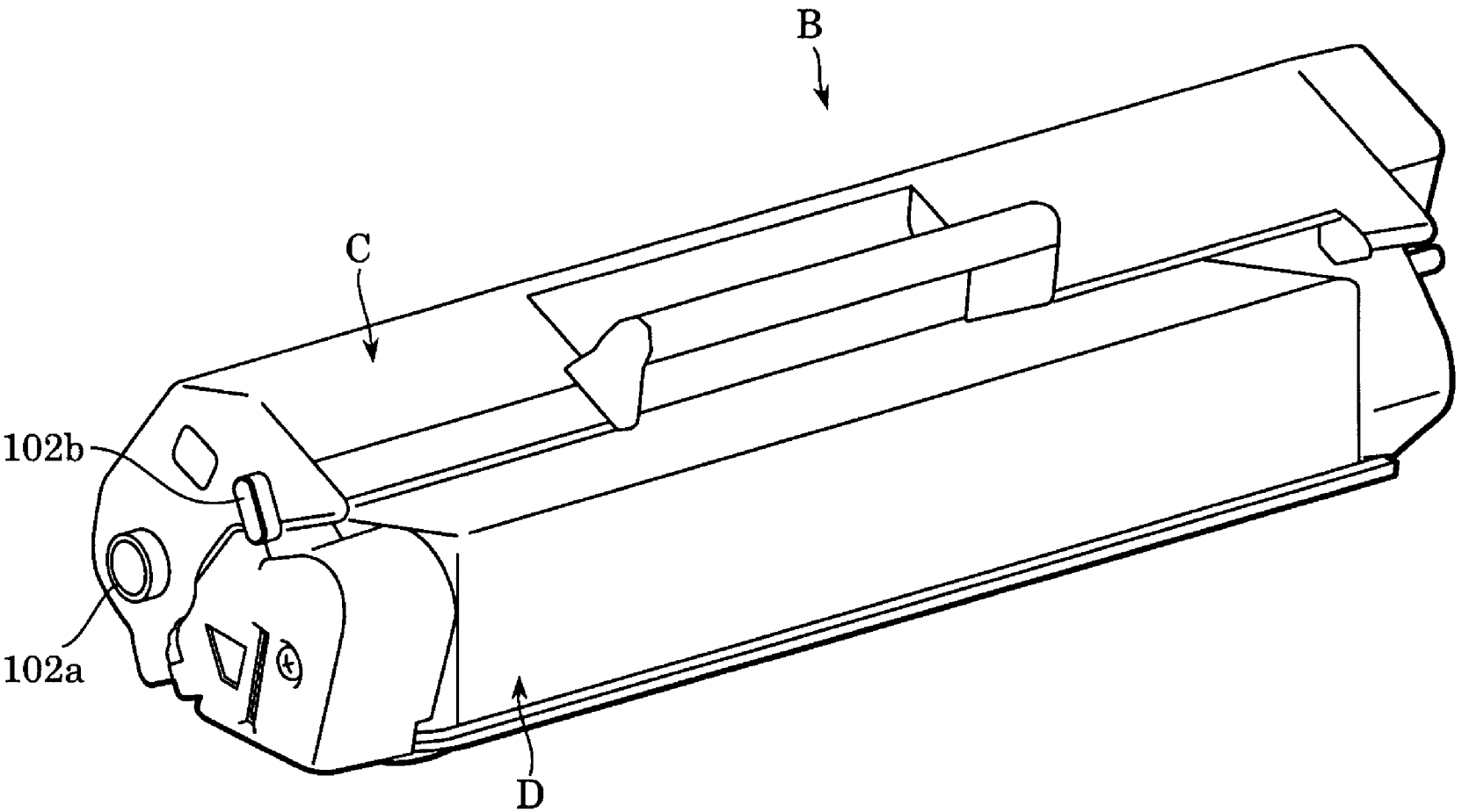
FIG. 3 is a perspective view of the process cartridge shown in FIG. 2.

On the other hand, as will be understood when referring also to FIG. 3, the drum frame 102 on the opposite side from the side holder 107 of the process cartridge B in the direction of the drum axis is formed with a projection 102*a* for covering the drum supporting shaft 100 and a projection 102*b* for controlling the position of the process cartridge B when attaching and detaching.

Figure 23:
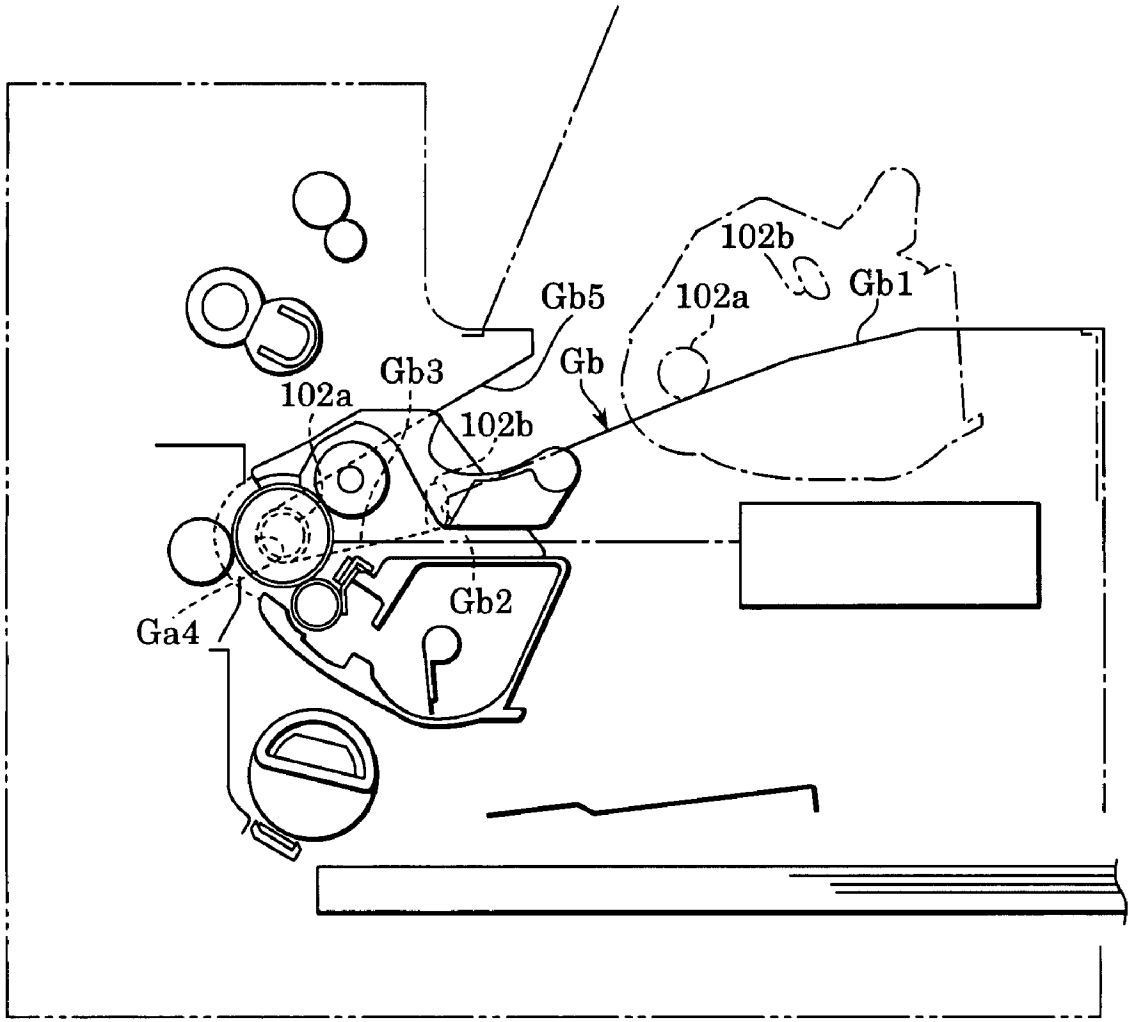
FIG. 23 is an explanatory pattern cross-sectional illustration of the image forming apparatus illustrating the state of mounting the process cartridge to the image forming apparatus.
Figure 25:
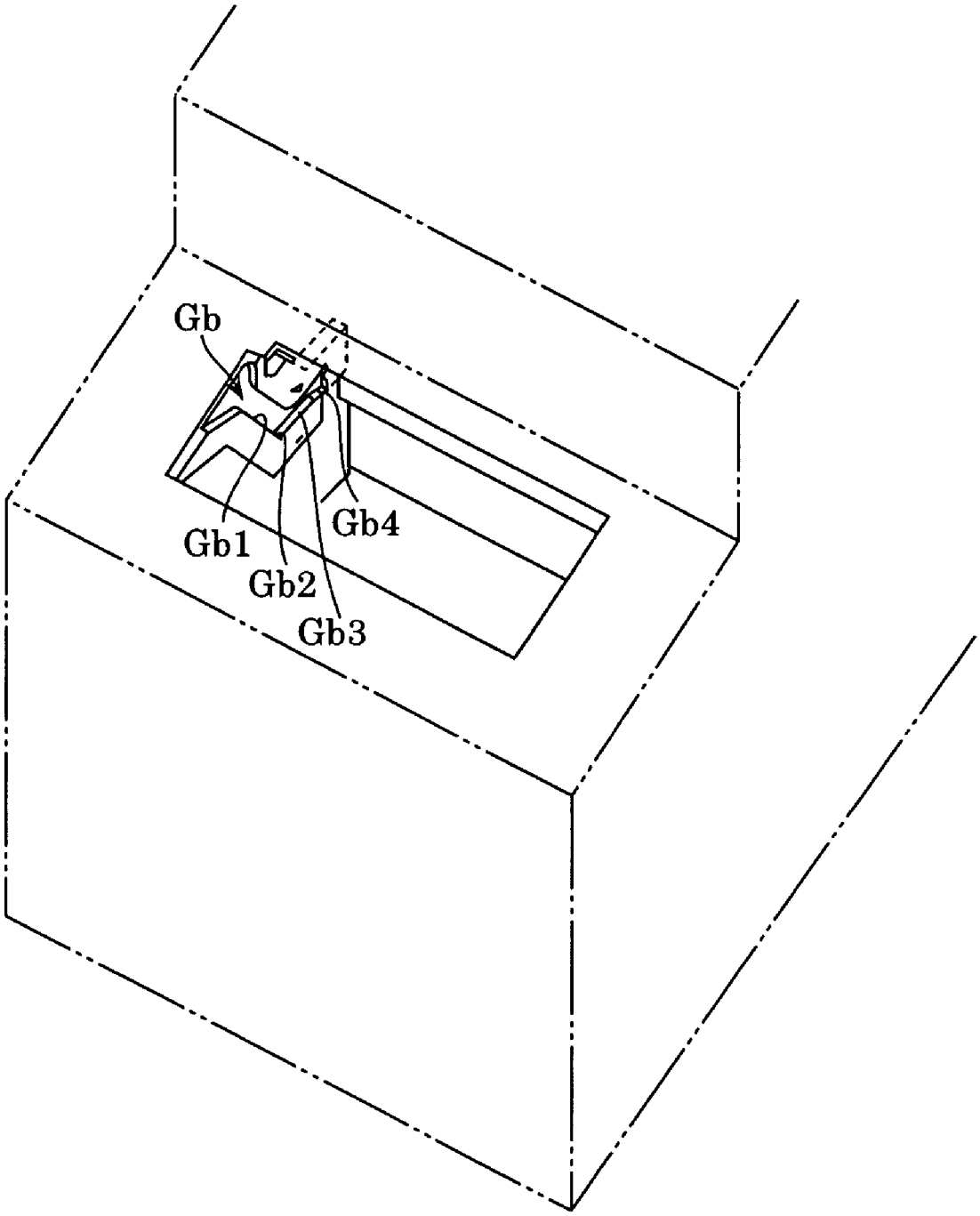
FIG. 25 is a perspective view showing a process cartridge mounting guide of the image forming apparatus according to the invention.

As shown in FIG. 23 and FIG. 25, the image forming apparatus body A0 is provided with a guiding member Gb as a second body guide for retaining the position of the process cartridge, which is controlled on the side of the side holder 107, so as to prevent the process cartridge from inclining with respect to the direction of the drum axis.

Referring now to FIG. 22 to FIG. 25, the state of mounting the process cartridge B to the apparatus body A will be described.

First, an opening and closing door member 6*a* constituting the discharging section 6 of the image forming apparatus body A0 is opened, so as to expose the guide members Ga, Gb. Then, as shown in FIG. 22 and FIG. 23 by a dashed line, the arcuate portions 107*d*, 107*e* of the process cartridge B are placed on a first guiding surface Ga1 of the guide member Ga such that the front portion is slightly bent in such a manner that the arcuate portion 107*d* of the process cartridge comes to the front and the rotation stopper 107*e* comes to the back. The projections 102*a*, 102*b* of the process cartridge B are adapted to the first guiding surface Gb1.

In this state, the process cartridge B is pressed inwardly of the image forming apparatus body A0.

Accordingly, the arcuate portion 107*d* and the rotation stopper 107*e* of the process cartridge B are slid and guided to a mounting position defined by a second guiding surface Ga2 formed substantially iperpendicularly to the first guiding surface Ga1, a third guiding surface Ga3 formed substantially horizontally from the second guiding surface Ga2, and a curved fourth guiding surface Ga4 formed continuous to the third guiding surface Ga3.

Accordingly, the process cartridge B is placed on the third guiding surface Ga3 in a state in which the arcuate portion

Figure 26A:
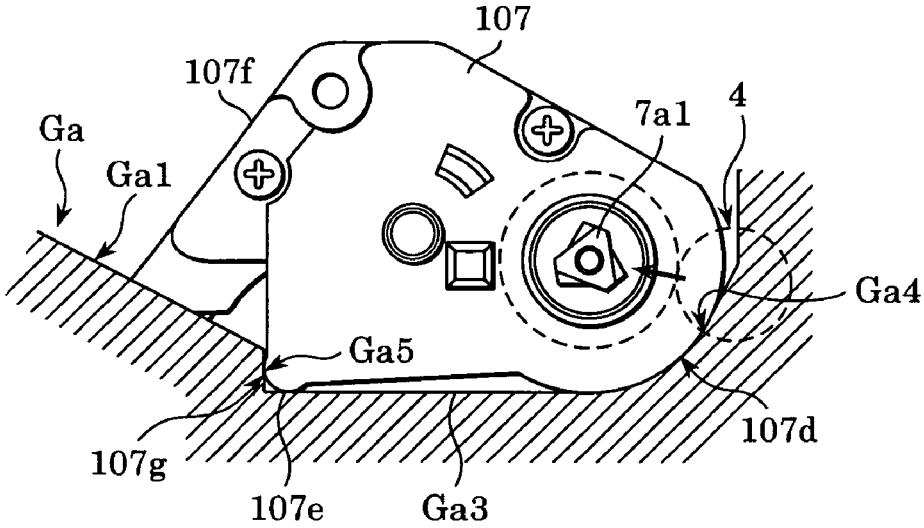
FIG. 26A is a drawing showing a positioning state of the process cartridge with respect to the image forming apparatus.

107*d* is in abutment with the fourth guiding surface Ga4 as the first body receiving portion and the rear curved surface of the rotation stopper 107*e* is in abutment with the second guiding surface Ga2. This state is shown in FIG. 26A. In this placement state, the transfer roller 4 and the photoreceptor drum 7 are brought into abutment and a repulsive force is exerted on the process cartridge B in the direction indicated by an arrow in FIG. 26A. In this case, a third abutting portion 107*g* abuts against a fifth guiding surface Ga5 located in the vicinity of Ga3 to prevent displacement of the process cartridge B.

On the other hand, the projections 102*a*, 102*b* on the opposite side of the process cartridge B is slid and guided to the mounting position defined by a second guiding surface Gb2 formed substantially perpendicularly to the first guiding surface Gb1, a third guiding surface Gb3 formed substantially horizontally from the second guiding surface Gb2, and a curved fourth guiding surface Gb4 formed continuous to the third guiding surface Gb3.

Figure 27:
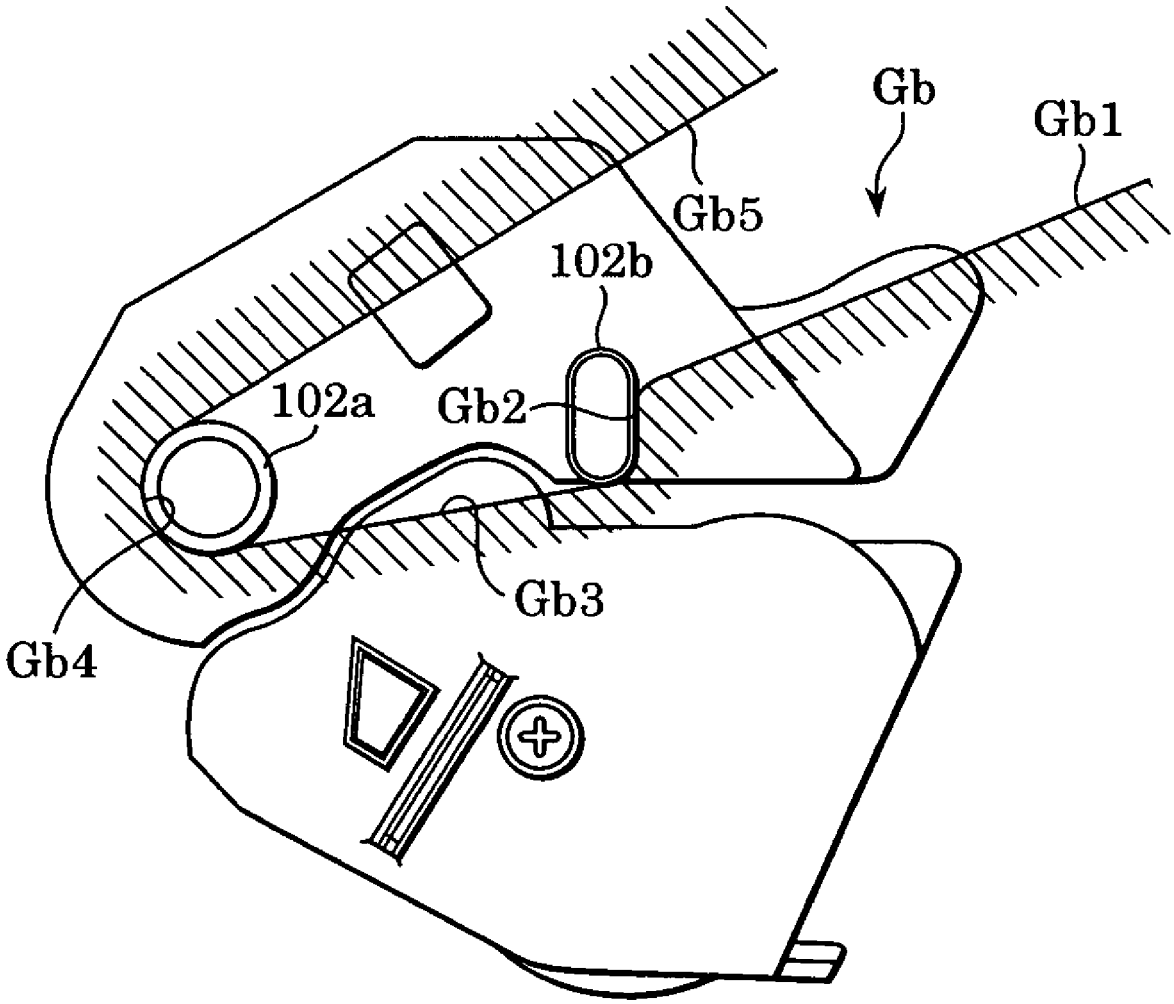
FIG. 27 is a drawing illustrating a positioning state of the process cartridge with respect to the image forming apparatus.

Accordingly, the process cartridge B is placed on the third guiding surface Gb3 in a state in which the projections 102*a*, 102*b* as the positioning member is positioned between the fourth guiding surface Gb4 as the second body receiving portion and the second guiding surface Gb2. This state is shown in FIG. 27.

With the process described above, the process cartridge B is mounted to the mounting position with respect to the apparatus body. Subsequently, when the door 6*a* of the image forming apparatus A is closed, the triangular coupling member 7*a*1 of the cartridge B is fitted to a triangular drive force transmitting member 200 in a form of twisted recess of the image forming apparatus body A0 shown in FIG. 24, and a rotational drive force is transmitted from the image forming apparatus body A0 to the process cartridge B.

Figure 26B:
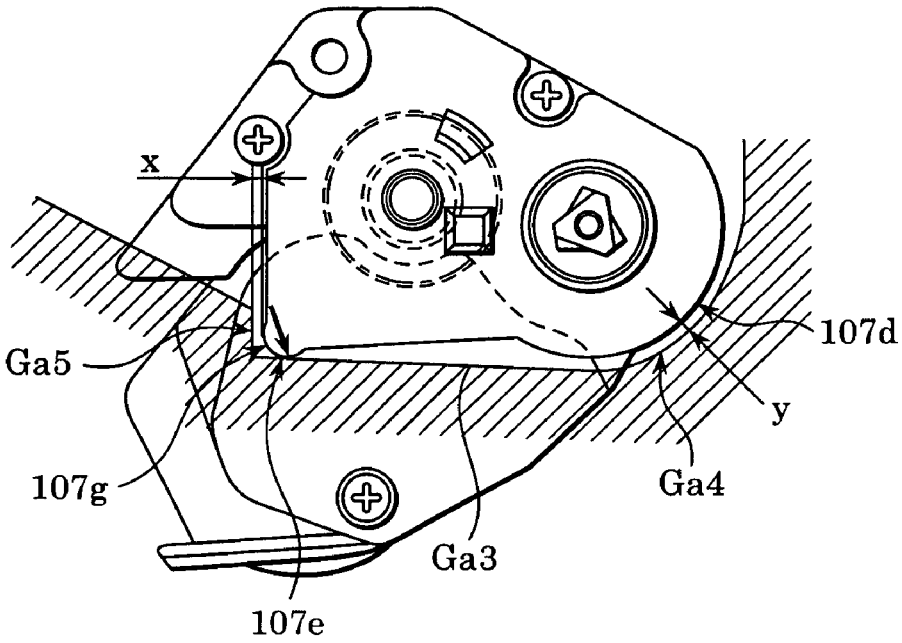
FIG. 26B is a drawing showing a positioning state of the process cartridge with respect to the image forming apparatus.

Accordingly, the process cartridge B rotates about the triangular coupling member 7*a*1 engaged as shown in FIG. 26B, that is, about the axis of the photoreceptor drum 7. At this time, the abutting portion of the side holder 107 which has been abutted with the guide maintains clearances x and y, and the rotation stopper 107*e* of the aforementioned side holder 107 comes into abutment with the third guiding surface Ga3 as the specified surface of the guiding member Ga for positioning in the rotational direction.

On the other hand, by mounting the process cartridge B, the projection 102*a* on the drum axis of the drum frame 102 on the opposite side in the direction of the drum axis is accommodated within a U-shaped groove formed by the fourth guiding surface Gb4 as a positioning member, and is positioned by a presser bar spring (not shown) for restraining a repulsive force or blurring, which may occur when being driven, of the transfer roller 4. The other projection 102*b* of the drum frame C is set to a position and a size which does not come into abutment with the image forming apparatus body A0 within the scope of accuracy of components and assembly.

The position described so far is the position of the process cartridge B at the time of image formation, and in this position, the image formation starts.

In order to remove the process cartridge B from the image forming apparatus body A0, the operation in the reverse direction from the operation described above is performed to bring an upper surface 107*f* opposing the arcuate portion 107*d* and the rotation stopper 107*e* of the process cartridge B on the side of the side holder 107, and the aforementioned projections 102*a*, 102*b* on the opposite side in the direction of the drum axis under control, so that the process cartridge B can be removed from the mounting position outwardly of the apparatus along the guide Ga, Gb of the image forming apparatus body A0 corresponding thereto.

When removing the process cartridge B from the mounting position, the projection 102*b* comes into contact with the fifth guiding surface Gb5 on the upper surface of the guiding member Gb and restricts the leading side of the process cartridge in the removing direction from excessively rotating upward by more than a predetermined amount.

Figure 31A:
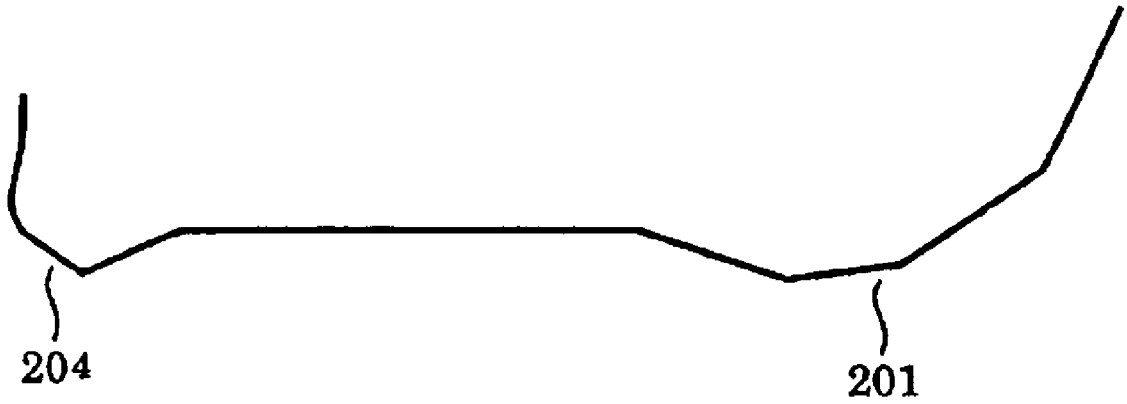
FIG. 31A is a schematic diagram showing a modification of an abutting portion in the invention.
Figure 31B:
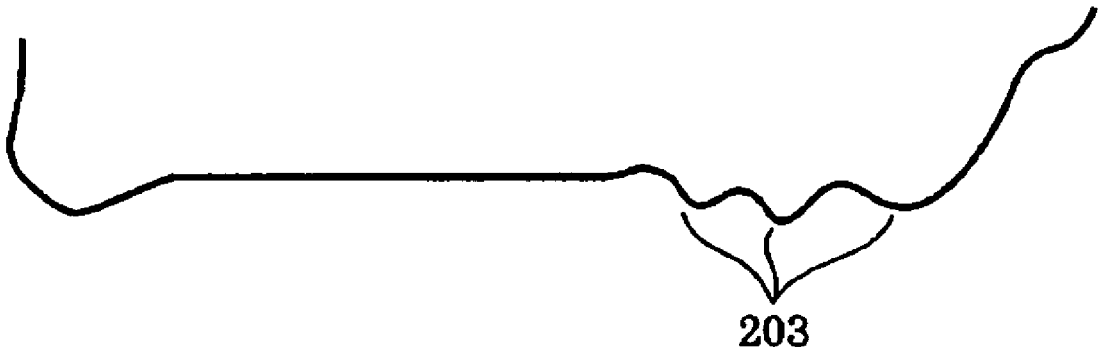
FIG. 31B is a schematic drawing showing a modification of the abutting portion in the invention.

In addition to the aforementioned first abutting portion, the second abutting portion and the third abutting portion can have polygonal shapes 204 or 201 as shown in FIG. 31A, the shape having a projection 203 as shown in FIG. 31B, or other applicable shapes as long as the structure has the aforementioned positioning function. The aforementioned first abutting portion, the second abutting portion, and the third abutting portion can have an arcuate shape so as to abut against the fourth guiding surface Ga4 even when the position of the process cartridge varies due to variations of the component within the tolerance.

(Driving Structure of Charging Roller 8)

Referring now to FIG. 5 to FIG. 12, the driving structure of the charging roller 8 will be describe. FIG. 7 to FIG. 12 illustrate a drive gear train of the process cartridge.

Drum Gear 7

Description will be made based on FIG. 11. In the present embodiment, the drum gear 7*a* is attached to one end of the drum cylinder 7A constituting the photoreceptor drum 7 and being provided with a photosensitive layer on the outer periphery thereof. The drum gear 7*a* transmits a rotational drive force to the charging roller 8, the transfer roller 4 and the developing roller 10*d*.

The drum gear 7*a* is coaxial with the drum cylinder 7A, and is a helical gear provided integrally with the drum cylinder 7A on the axially outside thereof. A shaft portion 7*a*4 is formed at the position overlapping with the drum helical gear portions 7*a*2, 7*a*3 in the longitudinally direction of the drum gear 7*a* and the cylinder 7A at the center of the drum gear 7*a*.

An annular gap 7*a*5 is formed between the outer peripheral surface of the shaft portion 7*a*4 and the inner peripheral surface of the drum helical gear portions 7*a*2, 7*a*3. The bearing 107*b* of the side holder 107 penetrates into the annular gap 7*a*5 and rotatably supports the shaft portion 7*a*4 when mounting the photoreceptor drum 7 to the cartridge frame (drum frame 102).

At the outer end of the shaft portion 7*a*4 of the drum gear 7*a*, there is formed a projection which constitutes a coupling device on the cartridge side, that is, the triangular coupling member 7*a*1. When the process cartridge B is fitted to the apparatus body A0, the triangular coupling 7*a*1 is fitted to a hole-shaped driving member constituting a coupling device provided on the apparatus body A0, that is, the drive force transmitting member 200 (See FIG. 24) substantially in the shape of twisted recessed triangle and receives transmission of a rotational drive force from the apparatus body A0. The projection 7*a*1 has a polygonal shape in cross section taken along the plane intersecting the axis of rotation and is twisted. The hole of the drive force transmitting member 200 has a polygonal shape in cross section taken along the plane intersecting the axis of rotation and is twisted.

In the present embodiment, the outer end surface of the shaft portion 7*a*4 is formed so as to be positioned on the inner side with respect to the outer end surface of the drum helical gear 7*a*, that is, the end surface of the drum helical gear portion 7*a*2 by the amount of ΔE. Therefore, the projection 7*a*1 partly overlaps the drum helical gear portion 7a2. In this arrangement, the face width of the drum gear 7a can be increased, and hence adequate strength or engagement is achieved, so that a satisfactory image can be obtained. Since the bearing 107b of the side holder 107 penetrates to rotatably support the shaft portion 7a4, a repulsive force caused by engagement of gears can be received by exactly below the gear, and hence stable rotational drive is achieved without generating a force to bend the photoreceptor drum.

As described above, the drum helical gear portion 7a has the first helical gear portion 7a2 positioned outside in the longitudinal direction of the cylinder 7A and the second helical gear portion 7a3 located inside the first helical gear portion 7a2. The first helical gear portion 7a2 and the second helical gear portion 7a3 are positioned in side-by-side relation, and the first helical gear portion 7a2 is smaller than the second helical gear portion 7a3 in diameter between tooth tips (that is, diameter of pitch circle). In this arrangement, the number of teeth of the drum gear can be selected according to the optimal numbers of rotation of the developing roller and the charging roller respectively.

In the present embodiment, the teeth of the first helical gear portion 7a2 and the second helical gear portion 7a3 are different in twisting direction. In the longitudinal direction of the drum cylinder 7A, the teeth of the first helical gear portion 7a2 is twisted rightward, and the teeth of the second helical gear portion 7a3 is twisted leftward when viewed from the side where the drum helical gear portion 7a is provided. Accordingly, when the process cartridge B is mounted to the apparatus body A0, and the photoreceptor drum 7 is rotated, the first helical gear portion 7a2 exerts an urging force to the driven gear in the direction toward the side opposite from the side at which the drum helical gear portion 7a is provided, that is, in the inward direction, and the second helical gear portion 7a3 exerts an urging force to the driven gear in the direction toward the side at which the drum helical gear portion 7a is provided, that is, in the outward direction.

In the present embodiment, an urging force is exerted to a gear 110b of the joint gear 110 which transmits a rotational drive force to the charging roller 8 in the direction toward the opposite side from the gear 110b in the longitudinal direction of the charging roller 8, that is, in the inward direction which is represented by an arrow in FIG. 11.

Idler Gear 111

The idler gear 111 is a two-speed gear having two gear portions 111a and 111b, and is rotatably supported by the shaft 102c (see FIG. 5) formed on the drum frame 102. The other end of the shaft 102c is supported by the side holder 107 in order to prevent inclination of the shaft due to a driving engagement force.

The two gear portions 111a and 111b of the idler gear 111 engage the joint gear portion 110b of the joint gear 110 and the first helical gear portion 7a2 of the drum gear 7a respectively for transmitting a rotational drive force from the drum gear 7a to the joint gear portion 110b.

Joint Gear 110

The joint gear 110 is provided with the joint gear portion 110b and a joint gear connecting portion 110a formed integrally with the joint gear portion 110b. The joint gear connecting portion 110a has a shape in which column-shaped projections are connected as will be understood from FIG. 9, and is provided at two symmetry positions with respect to the axis of rotation. Column-shaped projections 110a1, 110a2 of the joint gear connecting portion 110a are inclined at the extremities thereof toward the downstream side in the direction of rotation, respectively. The above-described inclination is about 7 degrees in the present embodiment. The joint gear portion 110b engages the aforementioned idler gear 111 to transmit a rotational drive force.

With a driving engagement force generated when driving the charging roller 8 at the point of engagement with the idler gear 111, a force to incline the axis of rotation of the joint gear 110 is exerted to the joint gear 110. In order to avoid influence by the force, the joint gear 110 is supported at both ends in the axial direction. Therefore, the joint gear 110 is formed with a joint gear fitting portion 110c extending parallel with the axis of rotation and having a constant diameter on the connecting side in the axial direction, that is, between the joint gear portion 110b and the joint gear connecting portion 110a, and is fitted to the through-hole 108 (see FIG. 5) formed on the drum frame 102, so as to be rotatably supported. Also, as described above, since an urging force is exerted to the joint gear portion 110b longitudinally inwardly (in the axial direction of the photoreceptor drum) as indicated by an arrow in FIG. 11, an inner side surface 110b1 of the joint gear portion 110b comes into abutment with an outer side surface 108a of the through-hole 108 when rotated, and hence stability of the charging roller 8 in the longitudinal direction during rotation is achieved.

On the other hand, a cylindrical supporting portion 110d having a constant diameter is formed at the other end of the joint gear 110, that is, on the longitudinally outer side with respect to the joint gear portion 110b and, as shown in FIG. 5, is supported by a supporting portion 107a provided on the side holder.

The joint gear 110 is connected to an intermediate-joint first-connecting portion 112a of an intermediate joint 112 for transmitting a drive force.

Intermediate Joint 112

Figure 8:
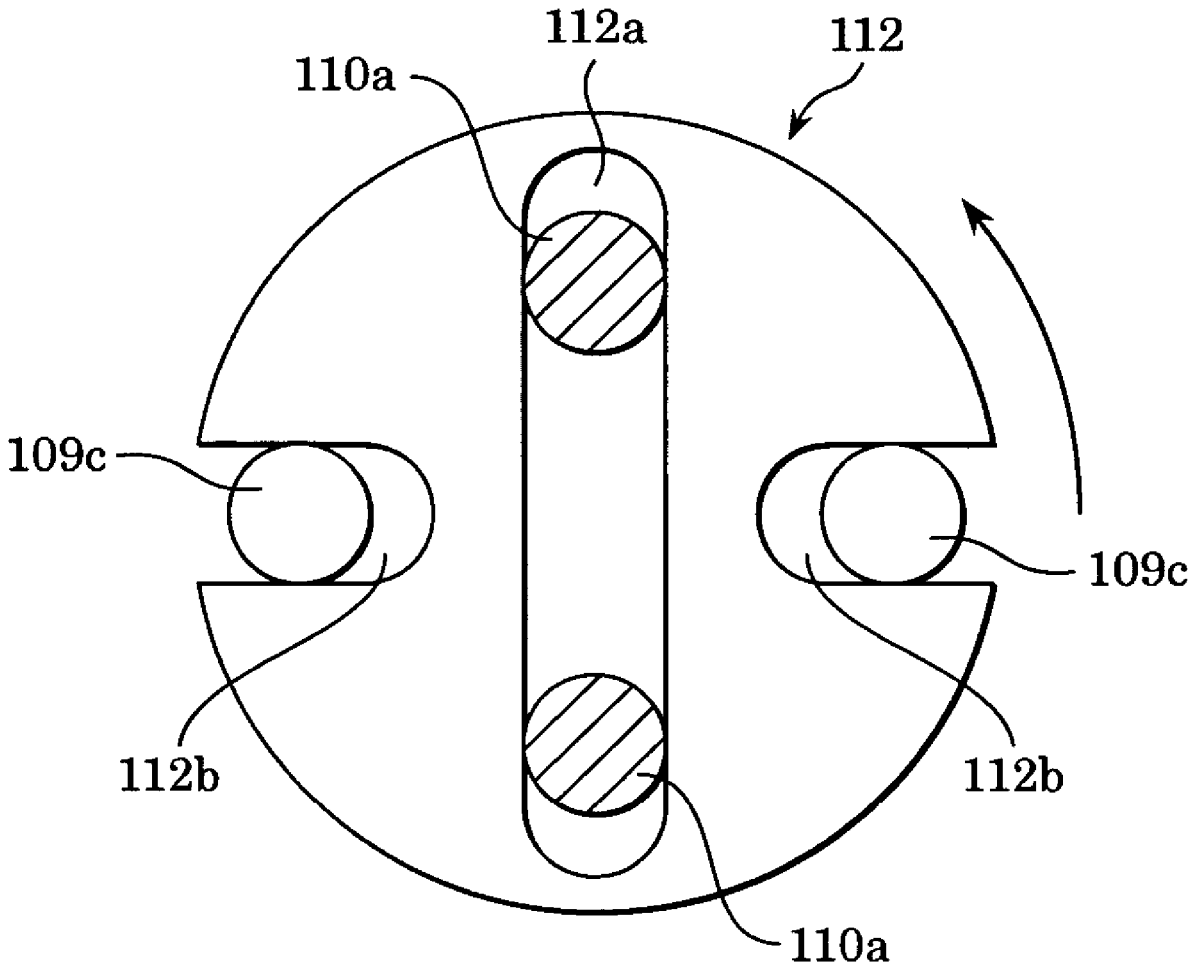
FIG. 8 is a front view illustrating a driving structure of a charging roller.

FIG. 8 is a cross-sectional view illustrating the connecting state among the joint gear 110, the intermediate joint 112, and the joint 109. Only the joint gear connecting portion 110a of the joint gear 110, and a joint connecting portion 109c of the joint 109 are shown in the drawing.

In FIG. 8, the joint gear connecting portion 110a is hatched in order to discriminate between the joint gear connecting portion 110a and the joint connecting portion 109c.

Figure 9:
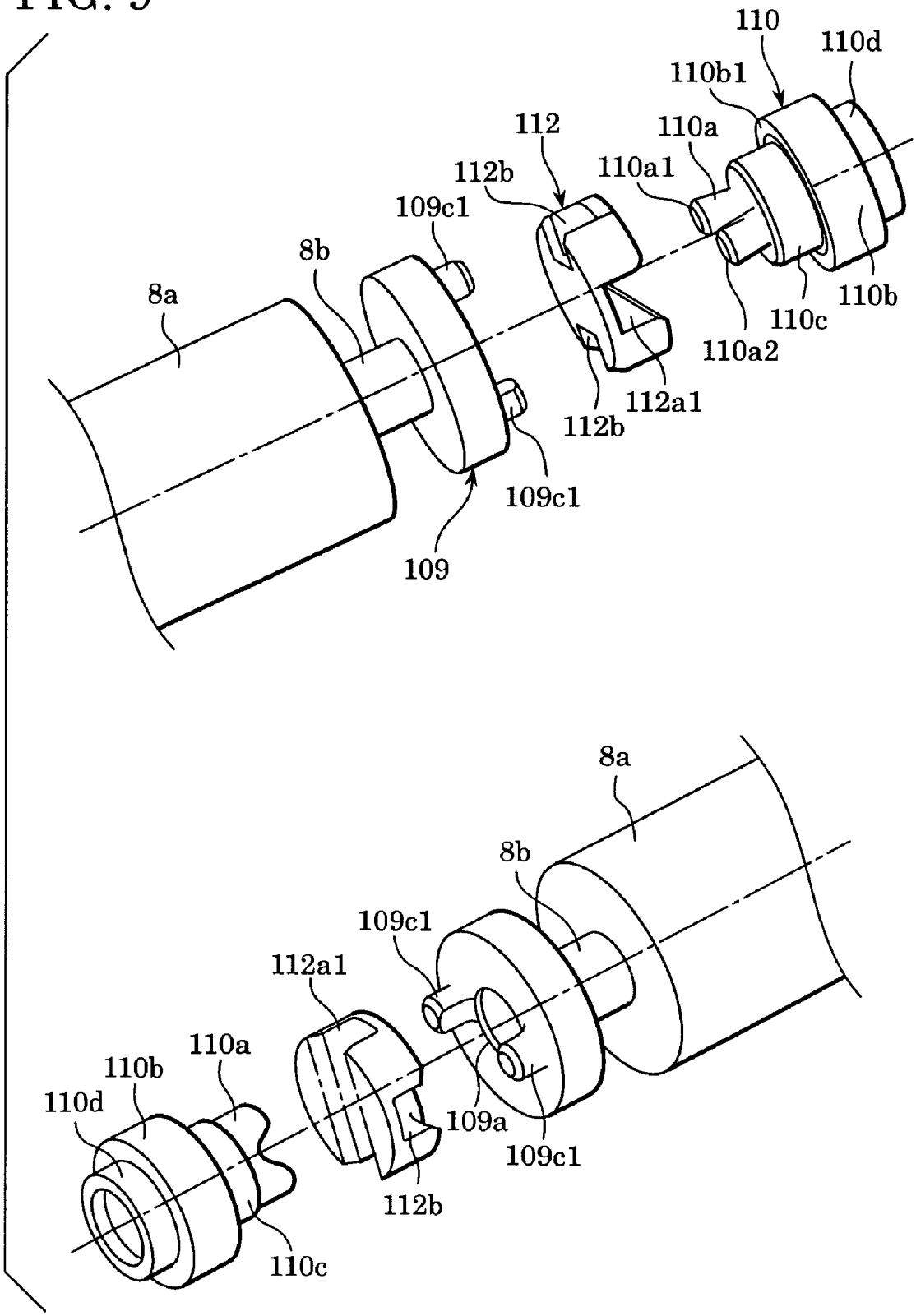
FIG. 9 is an exploded perspective view illustrating the driving structure of the charging roller.

The intermediate joint 112 is disposed so as to be clamped between the joint 109 and the joint gear 110 as shown in FIG. 9. On the surface opposing to the joint 109, there is provided an intermediate-joint second-connecting portion 112b, to which the cylindrical portion of the joint connecting portion 109c provided on the joint 109 is fitted to transmit a drive force. The intermediate-joint second-connecting portion 112b is an elongated hole opening at one end on the side of the outer periphery and is formed at two symmetry positions with respect to the axis of rotation. On the surface opposing the joint gear 110 is formed with the intermediate-joint first-connecting portion 112a, to which the joint gear connecting portion 110a provided on the joint gear is fitted to transmit a drive force. The intermediate-joint first-connecting portion 112a is an elongated groove shape opened at both ends, and is disposed symmetrically with respect to the axis of rotation.

Figure 34:
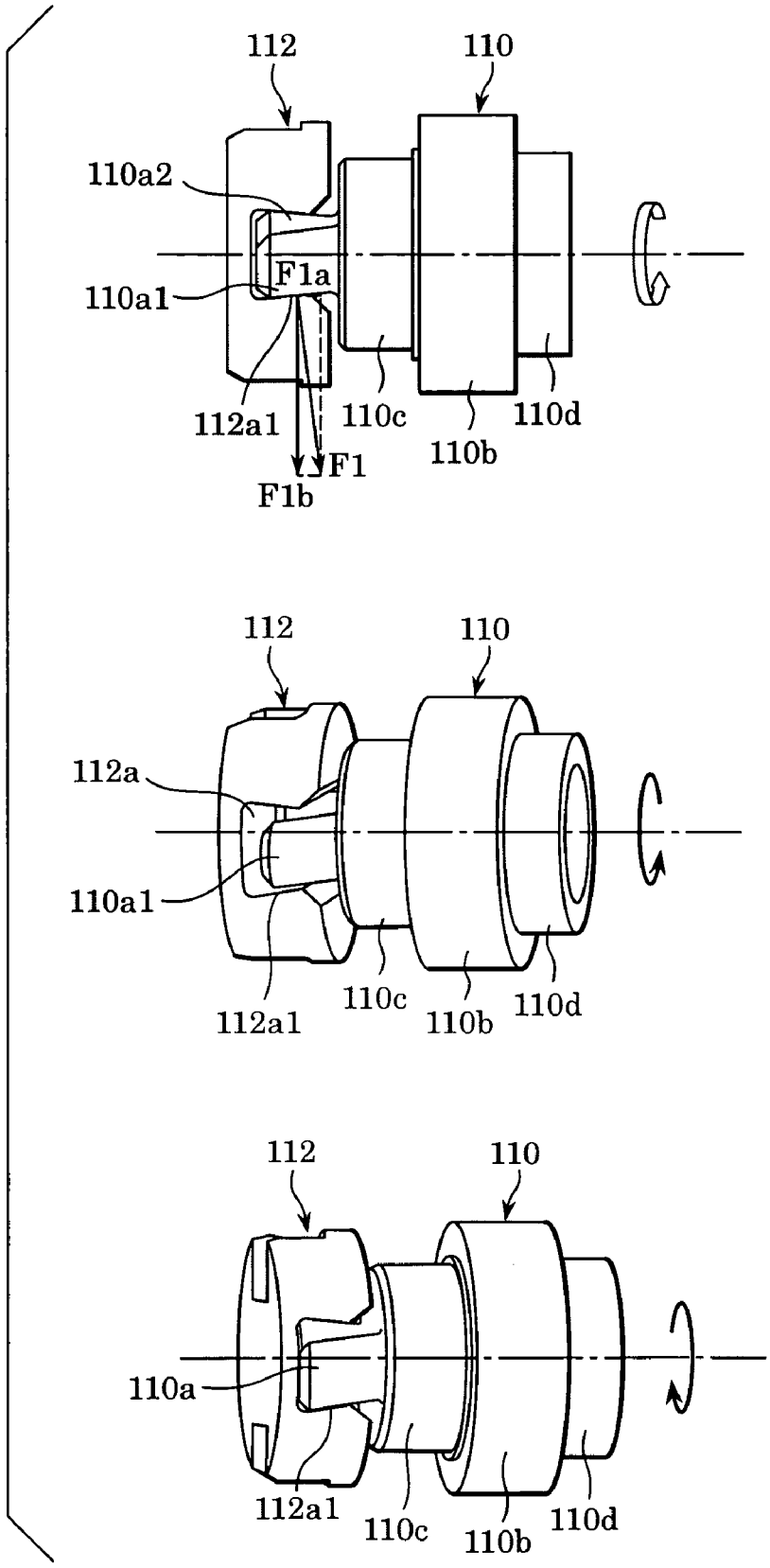
FIG. 34 is a side view and a perspective view showing transmission of a drive force between a joint gear and an intermediate joint.

An abutting surface 112a1 of an elongated slit constituting the intermediate-joint first-connecting portion 112a and being opened at both ends, which comes into abutment with the joint gear connecting portion 110a, is inclined with respect to the direction of axis of rotation, and the direction of inclination is such that the entrance side of the elongated groove is positioned on the upstream side with respect to the bottom side in the direction of rotation. In the present embodiment, this inclination is about 7 degrees. Accordingly, the joint gear connecting portion 110*a* and the abutting surface 112*a*1 come into abutment during rotation, and a rotational drive force is transmitted to the intermediate joint 112 by a component force F1*b* (as shown in FIG. 34) in the radial direction of a force F1 received from the joint gear 110, and is drawn into the joint gear 110 by a component force F1*a* in the thrust direction so that the intermediate joint 112 is moved toward the joint gear. Accordingly, the joint gear connecting portion 110*a* comes into abutment with the abutting surface 112*a*1 of the intermediate joint 112 over the entire area in the longitudinal direction or at least on the proximal side. Therefore, the load is exerted not only to the distal side of the joint gear connecting portion 110*a*, and hence it is advantageous in terms of strength of the proximal portion of the joint gear connecting portion 110*a*. Combined with an urging force applied to the charging roller 8 in the direction toward the drive force input side due to the intersecting angle described above, a force exerted to the charging roller 8 in the thrust direction is totally directed toward the drive force input side, and hence the position of the charging roller 8 in the thrust direction when driven is stabilized.

Figure 35:
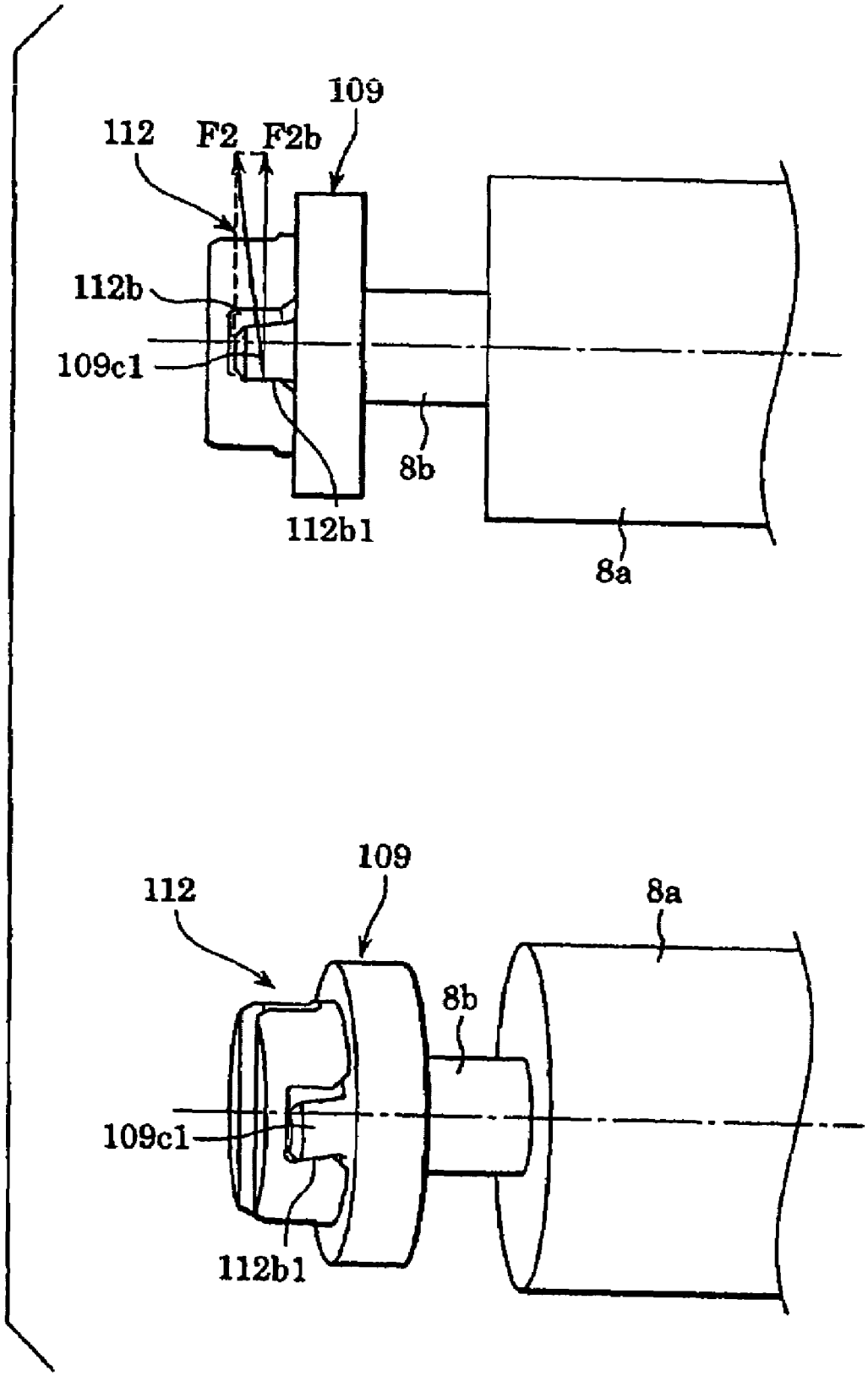
FIG. 35 is a side view and a perspective view showing transmission of a drive force between the joint gear and the intermediate joint.

In the elongated shaped hole with one end opened, which constitutes the intermediate-joint second-connecting portion 112*b*, an abutting surface 112*b*1 [As shown in FIG. 35] which comes into abutment with the joint connecting portion 109*c* is inclined with respect to the axis of rotation, and the direction of inclination is such that the entrance side of the elongated hole is located in the downstream side in the direction of rotation with respect to the bottom side in the direction of rotation. According to the present embodiment, the inclination is about 7 degrees.

The elongated hole of the intermediate-joint first-connecting portion 112*a* is symmetrical with respect to the axis of rotation, and likewise, the elongated hole with one end opened of the intermediate-joint second-connecting portion 112*b* is provided at two positions symmetrically with respect to the axis of rotation. The angle formed between the intermediate-joint first-connecting portion 112*a* and the intermediate-joint second-connecting portion 112*b* is substantially a right angle as shown in the drawing.

Joint 109

Figure 36:
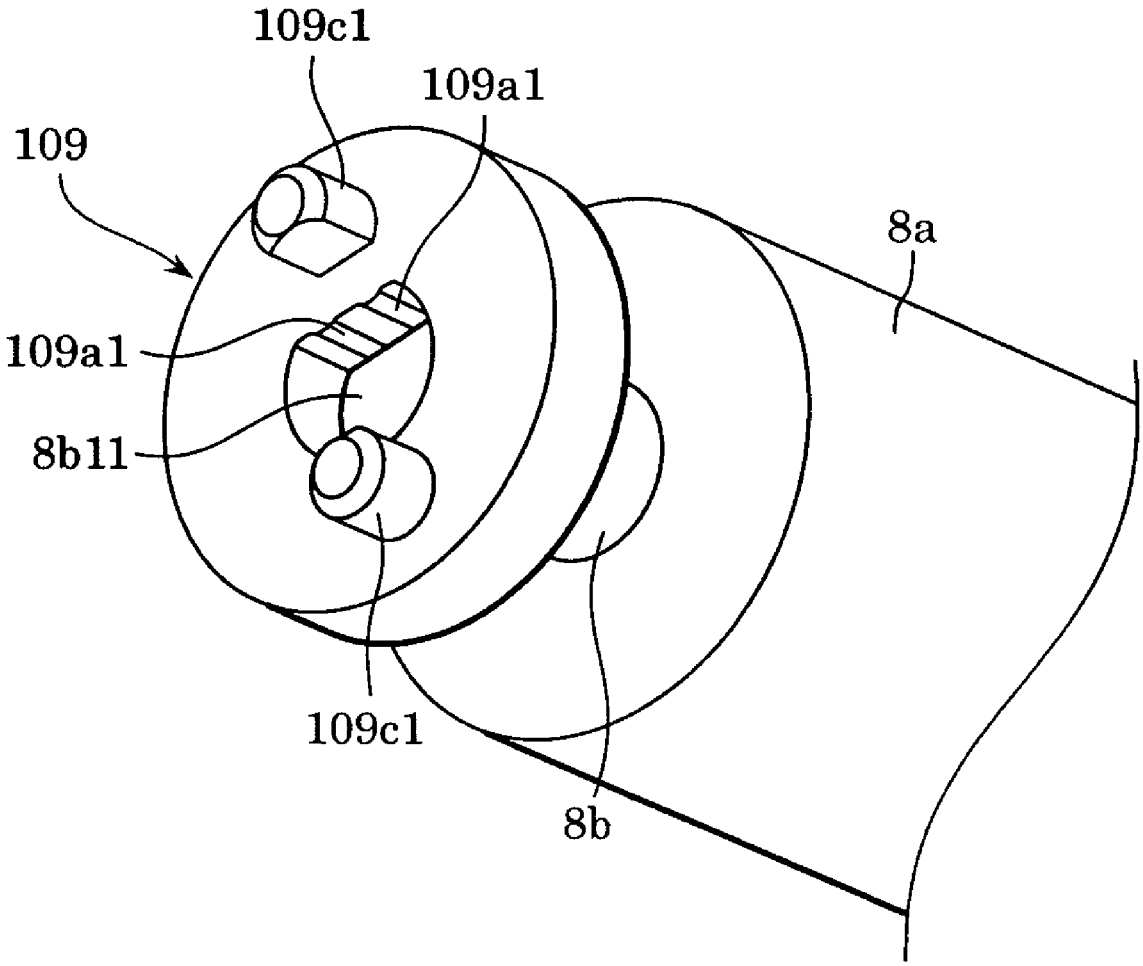
FIG. 36 is a perspective view showing mounting of the joint to the charging roller.

Referring to FIG. 36, the joint 109 as a drive force receiving portion is attached to the shaft portion 8*b*1 of the charging roller 8 in order to receive a drive force for rotating the charging roller 8. A D-cut portion 8*b*11 is formed on the shaft portion 8*b*1 of the charging roller 8. The joint 109 is formed with a D-cut hole 109*a* which fits on the D-cut portion 8*b*11 at the center thereof. Part of the D-cut hole 109*a* is formed with a projection 109*a*1, and the joint 109 is press-fitted into the charging roller 8. Accordingly, the joint 109 and the charging roller 8 are integrally rotated and is capable of moving integrally in the longitudinal direction.

The joint 109 is formed with the joint connecting portion 109*c*, which is formed by a column-shaped projection symmetrical with respect to the center axis. The joint connecting portion 109*c* is connected to the intermediate-joint second-connecting portion 112*b* of the intermediate joint 112 to be driven. The center axes of the two column-shaped joint connecting portions 109*c*1 disposed symmetrically with respect to the center axis are inclined at the extremities toward the upstream side of the direction of rotation. In case of the present embodiment, the aforementioned inclination is 7 degrees. Accordingly, when being rotated, the joint connecting portion 109*c*1 abuts against the abutting surface 112*b*1 formed on the intermediate-joint second-connecting portion 112*b*. At this time, the joint 109 is transmitted with rotational drive force by a component force F2*b* (as shown in FIG. 35) in the radial direction of a force F2 exerted from the intermediate joint 112, and is drawn toward the intermediate joint 112, that is, toward the drive force input side, so that the joint 109 and the charging roller 8 are moved integrally toward the intermediate joint 112. Accordingly, since the joint connecting portion 109*c*1 abuts against the abutting surface 112*b*1 of the intermediate joint 112 over the entire area in the longitudinal direction or at least on the proximal side, the load is exerted not only to the distal side of the joint connecting portion 109*c*, and hence it is advantageous in terms of strength of the proximal portion of the joint connecting portion 109*c*. Combined with an urging force applied to the charging roller 8 in the direction toward the drive force input side due to the intersecting angle described above, a force exerted to the charging roller 8 in the thrust direction is totally directed toward the drive force input side, and the position of the charging roller 8 in the thrust direction when driven is stabilized.

With the above-described structure of the connecting portion, since the intermediate-joint first-connecting portion 112*a* has a shape of an elongated hole, the intermediate joint 112 has a gap in the direction of the elongated hole and hence is slidable in a state in which the intermediate joint 112 is connected to the joint gear 110, that is, in a state in which the projection 110*a* is fitted into the hole 112*a*.

Also, since the intermediate-joint second-connecting portion 112*b* has a shape of an elongated hole, the intermediate joint 112 has an allowance (play) in the direction of elongated hole and hence is slidable in a state in which the intermediate joint 112 is connected to the joint 109, that is, in a state in which the projection 109*c* is fitted into the hole 112*b*.

As described above, the charging roller 8 is rotated in the opposite direction with respect to the photoreceptor drum 7 at the abutting portion, and hence are slid with each other, so that further close contact point is provided. In the present embodiment, so-called Oldham's coupling which transmits a drive force to the charging roller 8 via the intermediate coupling is employed, and the charging roller 8 is adapted to receive a force pulled toward the Oldham's coupling. However, the invention is not limited thereto. In other words, when a force applied from the photoreceptor drum to the charging roller at the contact point between the charging roller and the photoreceptor drum is assumed to be a first force, and a force applied from the drive force transmitting device, which transmits a drive force to the charging roller, to the charging roller is assumed to be a second force, if the directions of the first and second forces are the same, it is included in the scope of the present invention.

In the embodiment of the invention described above, various developing method including publicly known two-component magnetic brush developing method, cascade developing method, touch-down developing method, cloud developing method and so on may be employed as a developing method.

The electrophotographic photoreceptor employed is a photoconductive member, and the photoconductive member includes an amorphous silicone, amorphous selenium, zinc oxide, titanium oxide, and organic photo conductor (OPC). The drum-type photoreceptor for mounting the photoreceptor is formed by depositing or applying photo conductor on a cylinder of an aluminum alloy or the like.

As a material forming the drum frame, the toner developing frame, and the lid member may be plastic, for example, polystyrene, ABS resin (acrylonitrile/butadiene/styrene copolymer), denaturated PPE resin (polyphenylene ether), denaturated PPO resin (polyphenylene oxide), polycarbonate, polyethylene, polypropylene, and so on.

The aforementioned process cartridge includes, for example, the electrophotographic photoreceptor and the developing device, and at least one of the processing device. Therefore, in addition to the mode of the process cartridge shown in the aforementioned embodiment, for example, the one in which the electrophotographic photoreceptor and the developing device and the charging device are integrated into a cartridge so as to be detachably attached to the apparatus, the one in which the electrophotographic photoreceptor and the developing device are integrated into a cartridge so as to be detachably attached to the apparatus, the one in which the electrophotographic photoreceptor and the developing device are integrated into a cartridge so as to be detachably attached to the apparatus.

In other words, the aforementioned process cartridge is the one in which the charging device or the developing device and the electrophotographic photoreceptor are integrated into a cartridge, and the cartridge is adapted to be detachably attached to the image forming apparatus. Alternatively, it is the one in which the charging device and the developing device and the electrophotographic photoreceptor are integrated into a cartridge so as to be detachably attached to the image forming apparatus. Furthermore, it is the one in which at least the developing device and the electrophotographic photoreceptor are integrated into a cartridge so as to be detachably attached to the apparatus.

Furthermore, although the laser beam printer is exemplified as the image forming apparatus in the embodiment, the invention is not limited thereto, and it can also be used for, for example, an electrophotographic copying machine, a facsimile machine, or a word processor, as a matter of course.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A charging apparatus for charging a rotatable member, comprising:

a charging device contacting the member at a contact point and operable to charge the rotatable member; and a drive force transmitting device transmitting a drive force to the charging device so as to rotate the charging device along an axis of rotation;

wherein the rotatable member applies a first force to the charging device along the axis of rotation at the contact point, and the drive force transmitting device applies a second force to the charging device along the axis of rotation, and wherein directions of the first and second forces are substantially the same.

2. A charging apparatus according to claim 1, wherein a direction of rotation of the rotatable member at the contact point and the axis of rotation of the charging device are not orthogonal.

3. A charging apparatus according to claim 1, further comprising a drive force receiving portion provided at an end of the charging device along the axis of rotation and receiving the drive force transmitted from the drive force transmitting device, wherein the first force and the second force are directed from a center of the charging device toward the drive force receiving portion.

4. A charging apparatus according to claim 3, wherein the drive force receiving portion engages the drive force transmitting device at an engaging portion, and wherein the drive force receiving portion and the drive force transmitting device receive a third force to be pulled with respect to each other at the engaging portion.

5. A charging apparatus according to claim 3, wherein the drive force transmitting device includes an intermediate drive force transmitting member and a drive force transmitting member, wherein the intermediate drive force transmitting member engages the drive force receiving portion of the charging device to transmit the drive force received from the drive force transmitting member to the charging device, and wherein the drive force receiving portion and the intermediate drive force transmitting member receive a fourth force to be pulled with respect to each other at the engaging between the drive force receiving portion and the intermediate drive force transmitting member.

6. A charging apparatus according to claim 5, further comprising an Oldham's joint cooperating with the intermediate drive force transmitting member to transmit the drive force between the drive force receiving portion and the drive force transmitting device.

7. A charging apparatus according to claim 1, wherein conductive powder is interposed on the charging device.

8. A charging apparatus according to claim 7, wherein a first moving direction of the charging device is substantially opposite to a second moving direction of the rotatable member at the contact point.

9. A charging apparatus according to claim 1, wherein the charging device includes a charging roller having a shaft and a resilient device provided around the shaft.

10. A process cartridge detachably attached to an image forming apparatus body, comprising:

a rotatable member; and a charging apparatus according to claim 1.

11. An image forming apparatus for forming an image on sheets, comprising:

a rotatable member facilitating transferring the image to the sheets;

a charging apparatus according to claim 1; and a fixer fixing the image on the sheets.

* * * * *